US009845758B2

(12) United States Patent
Tomomatsu et al.

(10) Patent No.: US 9,845,758 B2
(45) Date of Patent: Dec. 19, 2017

(54) ENGINE CONTROL APPARATUS

(71) Applicant: Mitsubishi Electric Corporation, Tokyo (JP)

(72) Inventors: Nobuyoshi Tomomatsu, Tokyo (JP); Shuichi Wada, Hyogo (JP); Kenichi Yamagata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/149,328

(22) Filed: May 9, 2016

(65) Prior Publication Data

US 2017/0152807 A1 Jun. 1, 2017

(30) Foreign Application Priority Data

Nov. 27, 2015 (JP) ..... 2015-231546

(51) Int. Cl.
*F02D 41/14* (2006.01)
*F02D 41/24* (2006.01)

(52) U.S. Cl.
CPC ..... *F02D 41/2454* (2013.01); *F02D 41/1455* (2013.01); *F02D 41/1458* (2013.01); *F02D 41/1479* (2013.01)

(58) Field of Classification Search
CPC ..... F02D 41/1455; F02D 41/1458; F02D 41/1459; F02D 41/1479; F02D 41/148; F02D 41/2454
(Continued)

(56) References Cited

U.S. PATENT DOCUMENTS 4,526,001 A * 7/1985 Burns ..... F02D 41/2458 123/695
4,748,953 A * 6/1988 Osuga ..... F02D 41/1483 123/696
(Continued)

FOREIGN PATENT DOCUMENTS

JP 2010203407 A 9/2010
JP 4607163 B2 1/2011
JP 201594273 A 5/2015

OTHER PUBLICATIONS

Communication dated Jul. 12, 2016, from the Japanese Patent Office in counterpart application No. 2015-231546.

*Primary Examiner* — Erick Solis
(74) *Attorney, Agent, or Firm* — Sughrue Mion, PLLC; Richard C. Turner

(57) ABSTRACT

An air-fuel ratio region detection unit, including a first determination voltage higher than a target voltage value indicating the stoichiometric air-fuel ratio, and a second determination voltage lower than the target voltage value, determines that an air-fuel ratio of an engine is within a first rich region when an oxygen sensor output equals or exceeds the first determination voltage, determines that the air-fuel ratio is within a second rich region when the oxygen sensor output equals or exceeds the target voltage value but is lower than the first determination voltage, determines that the air-fuel ratio is within a second lean region when the oxygen sensor output equals or exceeds the second determination voltage but is lower than the target voltage value, and determines that the air-fuel ratio is within a first lean region when the oxygen sensor output is lower than the second determination voltage.

7 Claims, 12 Drawing Sheets

(58) Field of Classification Search
USPC ..... 701/109; 123/672, 695, 703
See application file for complete search history.

(56) References Cited

U.S. PATENT DOCUMENTS

2012/0234085 A1* 9/2012 Nishida ..... F02D 41/0097
73/114.72
2014/0136082 A1* 5/2014 Fosaaen ..... F02D 41/1446
701/109

* cited by examiner

FIG. 5A

| AIR-FUEL RATIO | FIRST LEAN REGION | SECOND LEAN REGION | TARGET VOLTAGE | SECOND RICH REGION | FIRST RICH REGION |
|---|---|---|---|---|---|
| Gp1 | +0.01 | +0.005 | 0 | −0.005 | −0.01 |

FIG. 5B

| AIR-FUEL RATIO | LEAN REGION | TARGET VOLTAGE | RICH REGION |
|---|---|---|---|
| Gp2 | +0.005 | 0 | −0.005 |

FIG. 6A

| AIR-FUEL RATIO | FIRST LEAN REGION | SECOND LEAN REGION | TARGET VOLTAGE | SECOND RICH REGION | FIRST RICH REGION |
|---|---|---|---|---|---|
| Gi1 | +0.001 | +0.0005 | 0 | −0.0005 | −0.001 |

FIG. 6B

| AIR-FUEL RATIO | LEAN REGION | TARGET VOLTAGE | RICH REGION |
|---|---|---|---|
| Gi2 | +0.0005 | 0 | −0.0005 |

FIG. 10A

| Ne [r/min] \ θ [deg] | 0 | 10 | 20 | 30 | 40 | 50 | 60 | 70 | 80 | 90 |
|---|---|---|---|---|---|---|---|---|---|---|
| 1000 | 600 | 600 | 600 | 700 | 700 | 700 | 700 | 700 | 700 | 700 |
| 2000 | 600 | 600 | 600 | 700 | 700 | 700 | 700 | 700 | 700 | 700 |
| 3000 | 600 | 600 | 600 | 700 | 700 | 700 | 700 | 700 | 700 | 700 |
| 4000 | 600 | 600 | 700 | 800 | 800 | 800 | 800 | 800 | 800 | 800 |
| 5000 | 600 | 700 | 700 | 800 | 800 | 800 | 800 | 800 | 800 | 800 |
| 6000 | 700 | 700 | 700 | 800 | 800 | 800 | 800 | 800 | 800 | 800 |
| 7000 | 700 | 700 | 800 | 900 | 900 | 900 | 900 | 900 | 900 | 900 |
| 8000 | 700 | 800 | 800 | 900 | 900 | 900 | 900 | 900 | 900 | 900 |
| 9000 | 800 | 800 | 800 | 900 | 900 | 900 | 900 | 900 | 900 | 900 |
| 10000 | 800 | 800 | 800 | 900 | 900 | 900 | 900 | 900 | 900 | 900 |

FIG. 10B

| Ne [r/min] \ Pa [kPa] | 55 | 60 | 65 | 70 | 75 | 80 | 85 | 90 | 95 | 100 |
|---|---|---|---|---|---|---|---|---|---|---|
| 1000 | 600 | 600 | 600 | 700 | 700 | 700 | 700 | 700 | 700 | 700 |
| 2000 | 600 | 600 | 600 | 700 | 700 | 700 | 700 | 700 | 700 | 700 |
| 3000 | 600 | 600 | 600 | 700 | 700 | 700 | 700 | 700 | 700 | 700 |
| 4000 | 600 | 600 | 700 | 800 | 800 | 800 | 800 | 800 | 800 | 800 |
| 5000 | 600 | 700 | 700 | 800 | 800 | 800 | 800 | 800 | 800 | 800 |
| 6000 | 700 | 700 | 700 | 800 | 800 | 800 | 800 | 800 | 800 | 800 |
| 7000 | 700 | 700 | 800 | 900 | 900 | 900 | 900 | 900 | 900 | 900 |
| 8000 | 700 | 800 | 800 | 900 | 900 | 900 | 900 | 900 | 900 | 900 |
| 9000 | 800 | 800 | 800 | 900 | 900 | 900 | 900 | 900 | 900 | 900 |
| 10000 | 800 | 800 | 800 | 900 | 900 | 900 | 900 | 900 | 900 | 900 |

ENGINE CONTROL APPARATUS

BACKGROUND OF THE INVENTION

1. Field of the Invention

This invention relates to an engine control apparatus, and more particularly to an engine control apparatus installed in a vehicle having an oxygen sensor, an oxygen sensor output value of which varies in accordance with an oxygen concentration of exhaust gas.

2. Description of the Related Art

An oxygen sensor may be disposed on an exhaust path of a vehicle. Air-fuel ratio feedback control is performed in the vehicle on the basis of an output voltage of the oxygen sensor in order to adjust a fuel injection amount so that an air-fuel ratio of an engine reaches the stoichiometric air-fuel ratio. As a result, a purification performance of a three-way catalyst that purifies exhaust gas can be maintained.

The output voltage of the oxygen sensor varies according to an oxygen concentration of the exhaust gas. Further, the output voltage of the oxygen sensor exhibits a characteristic of varying rapidly about the stoichiometric air-fuel ratio. Using this characteristic, a determination can be made from the output voltage value of the oxygen sensor as to whether the air-fuel ratio of the engine is richer or leaner than the stoichiometric air-fuel ratio. A determination result is expressed by binary data based on whether the air-fuel ratio is richer or leaner than the stoichiometric air-fuel ratio. Air-fuel ratio feedback based on this binary determination result is implemented widely.

In recent years, as exhaust gas regulations become stricter, there is increasing demand for an improvement in the precision of air-fuel ratio feedback control. As described above, the output voltage of the oxygen sensor varies rapidly about the stoichiometric air-fuel ratio. More specifically, when the air-fuel ratio advances to the rich side of the stoichiometric air-fuel ratio, the output voltage of the oxygen sensor increases rapidly initially and then increases gently. When the air-fuel ratio advances to the lean side of the stoichiometric air-fuel ratio, meanwhile, the output voltage of the oxygen sensor decreases rapidly initially and then decreases gently.

Further, the characteristic of the oxygen sensor output outside the vicinity of the stoichiometric air-fuel ratio is affected greatly by variation in a sensor element temperature. When an oxygen sensor is used as an air-fuel ratio sensor, it is important to estimate the sensor element temperature of the oxygen sensor. Accordingly, an air-fuel ratio feedback method that includes detection or estimation of the sensor element temperature of the oxygen sensor has been proposed (see JP 4607163 B2, for example).

In a system configuration described in JP 4607163 B2, a three-dimensional oxygen sensor map is stored in advance in a memory of a control unit. On the oxygen sensor map, the sensor element temperature of the oxygen sensor is stored in association with an engine rotation speed and a throttle opening. The sensor element temperature of the oxygen sensor is estimated by reading the sensor element temperature from the map in accordance with operating conditions. The oxygen sensor output value is then corrected on the basis of the estimation result of the sensor element temperature. Further, an actual air-fuel ratio (referred to hereafter as the actual air-fuel ratio) is calculated from the corrected oxygen sensor output value. Hence, feedback control is performed on the basis of a deviation between the actual air-fuel ratio and a target air-fuel ratio (the stoichiometric air-fuel ratio). According to JP 4607163 B2, therefore, a large improvement in control precision can be achieved over conventional, widely implemented air-fuel ratio feedback control based on a binary determination result (i.e. whether the air-fuel ratio is richer or leaner than the stoichiometric air-fuel ratio).

SUMMARY OF THE INVENTION

However, with the simplified sensor element temperature estimation method implemented in JP 4607163 B2, various environmental conditions in which a motorcycle is used, such as a temperature condition, an atmospheric pressure condition, and a humidity condition, for example, are not taken into account. During an actual vehicle operation, therefore, an error that adversely affects convergence of the air-fuel ratio may occur in the estimation result of the sensor element temperature.

The following two methods, for example, may be considered as methods for improving the precision with which the sensor element temperature of the oxygen sensor is estimated.

In a first method, sensor element temperatures under various environmental conditions and operating conditions are recorded in detail in a memory using a large memory and a high-performance CPU. Further, various sensors are mounted on the vehicle side in order to measure the environmental conditions. Hence, during a vehicle operation, the usage environment is measured by the sensors in real time, whereupon an appropriate sensor element temperature of the oxygen sensor is read from the memory.

In a second method, a special oxygen sensor with which the sensor element temperature of the oxygen sensor can be measured directly is provided.

However, both of these methods are costly, and cannot therefore be applied realistically to an inexpensive system such as that of a motorcycle.

This invention has been made to solve the problem described above, and an object thereof is to obtain an engine control apparatus that can make effective use of a characteristic of an oxygen sensor output voltage to enable an air-fuel ratio of an engine to converge on the stoichiometric air-fuel ratio more quickly than with air-fuel ratio control based on a binary determination result, which is currently widely used.

Solution to Problem

This invention is an engine control apparatus having an oxygen sensor that outputs an oxygen sensor output value corresponding to an oxygen concentration of exhaust gas from an engine, and an air-fuel ratio feedback control unit that performs air-fuel ratio feedback control on the basis of the oxygen sensor output value in order to adjust an amount of fuel injected into the engine, the air-fuel ratio feedback control unit including: an air-fuel ratio region detection unit that detects an air-fuel ratio region, among four or more preset air-fuel ratio regions, to which an air-fuel ratio of the engine belongs on the basis of the oxygen sensor output value; and an air-fuel ratio feedback control correction amount calculation unit that calculates a first feedback control correction amount for use during the air-fuel ratio feedback control in accordance with the air-fuel ratio region detected by the air-fuel ratio region detection unit, wherein the four or more regions include at least a first rich region and a second rich region set on a rich side of a stoichiometric air-fuel ratio in ascending order of a value of the air-fuel ratio, and a first lean region and a second lean region set on a lean side of the stoichiometric air-fuel ratio in descending order of the value of the air-fuel ratio, and the air-fuel ratio region detection unit includes a first determination voltage set at a higher value than a target voltage value that is a voltage value indicating the stoichiometric air-fuel ratio, and a second determination voltage set at a lower value than the target voltage value, compares the oxygen sensor output value respectively with the first determination voltage and the second determination voltage, determines that the air-fuel ratio of the engine is within the first rich region when the oxygen sensor output value equals or exceeds the first determination voltage, determines that the air-fuel ratio of the engine is within the second rich region when the oxygen sensor output value equals or exceeds the target voltage value but is lower than the first determination voltage, determines that the air-fuel ratio of the engine is within the second lean region when the oxygen sensor output value equals or exceeds the second determination voltage but is lower than the target voltage value, and determines that the air-fuel ratio of the engine is within the first lean region when the oxygen sensor output value is lower than the second determination voltage.

Advantageous Effects of Invention

In the engine control apparatus according to this invention, the air-fuel ratio region to which the air-fuel ratio of the engine belongs, among the four or more divided air-fuel ratio regions, is determined on the basis of the oxygen sensor output value VO2 of the oxygen sensor, whereupon air-fuel ratio feedback control is performed in accordance with the corresponding air-fuel ratio region. Therefore, the effects of an error occurring during estimation of a sensor element temperature can be suppressed, with the result that convergence of the air-fuel ratio of the engine on the stoichiometric air-fuel ratio can be achieved more quickly than with air-fuel ratio control based on a binary determination result, which is currently used widely.

BRIEF DESCRIPTION OF THE DRAWINGS

FIG. 5A is an illustrative view showing an example of a proportional gain map used in the first embodiment of this invention;

FIG. 5B is an illustrative view showing another example of the proportional gain map, which is used in a modified example of the first embodiment of this invention;

FIG. 6A is an illustrative view showing an example of an integral gain map used in the first embodiment of this invention;

FIG. 6B is an illustrative view showing another example of the integral gain map, which is used in the modified example of the first embodiment of this invention;

FIG. 10A is an illustrative view showing an example of an oxygen sensor basic temperature map used in the modified example of the first embodiment of this invention;

FIG. 10B is an illustrative view showing another example of the oxygen sensor basic temperature map used in the modified example of the first embodiment of this invention;

DESCRIPTION OF THE PREFERRED EMBODIMENTS

First Embodiment

A first embodiment of this invention will be described below with reference to the drawings.

Figure 1:
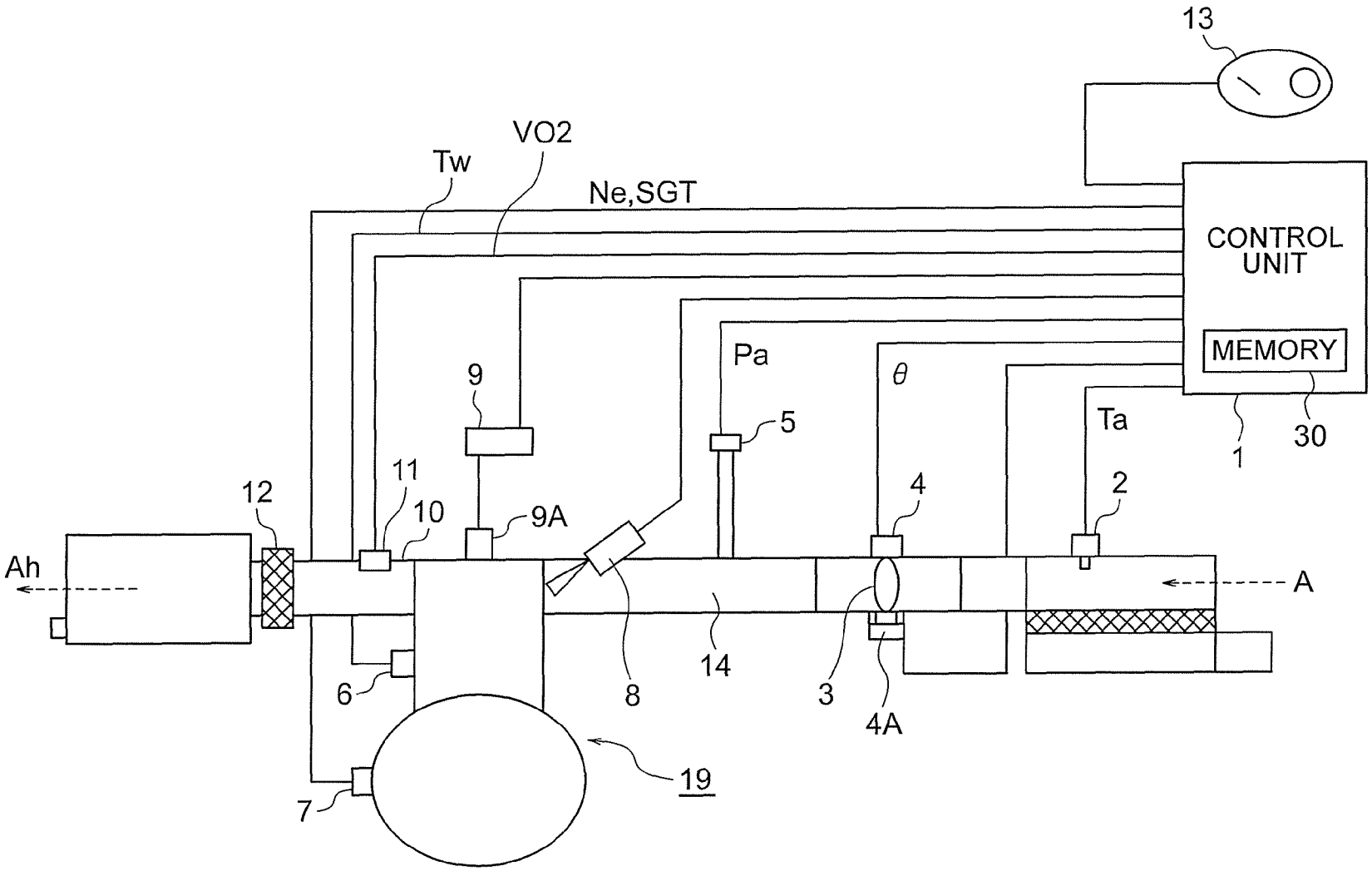
FIG. 1 is a view showing a configuration of an engine control apparatus according to a first embodiment of this invention, together with an engine.
Figure 2:
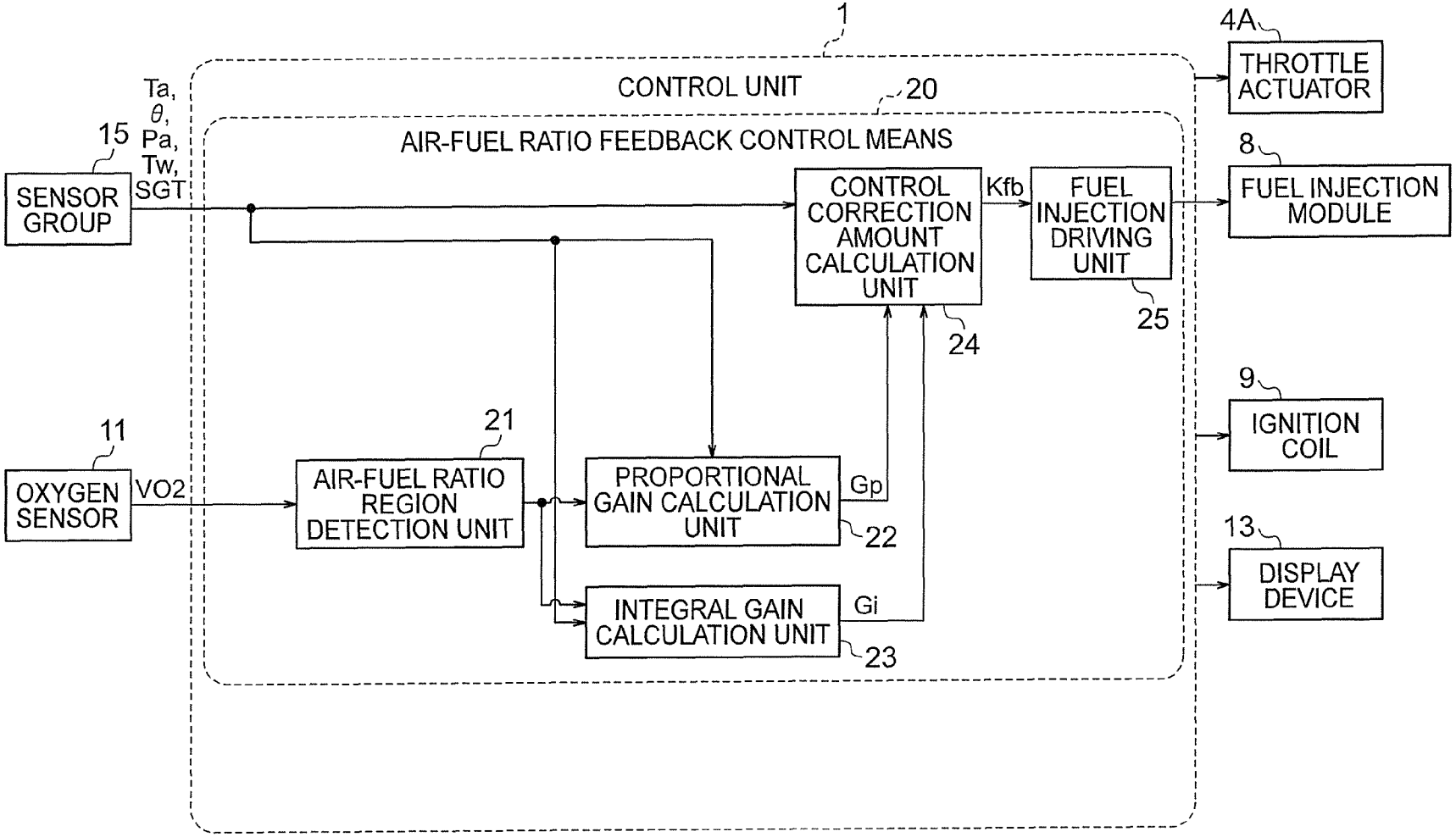
FIG. 2 is a block diagram showing a functional configuration of the engine control apparatus according to the first embodiment of this invention.
Figure 3:
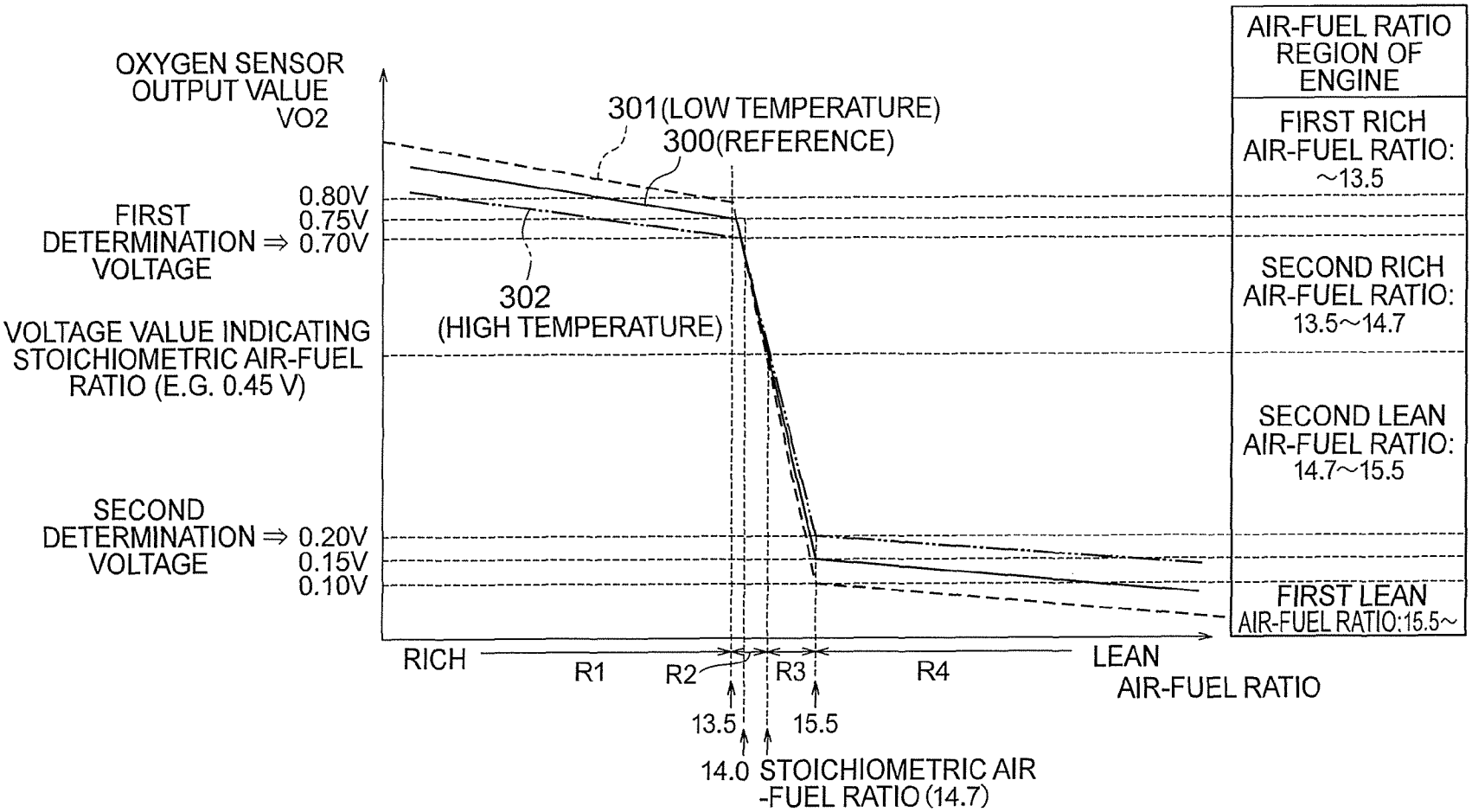
FIG. 3 is an illustrative view showing an output characteristic of an oxygen sensor and air-fuel ratio regions of the engine used in the first embodiment of this invention.

FIG. 1 is a view showing a configuration of an engine control apparatus according to the first embodiment of this invention when attached to an engine of a vehicle. FIG. 2 is a block diagram showing a functional configuration of a control unit 1 shown in FIG. 1. FIG. 3 is an illustrative view showing a relationship between an output characteristic of an oxygen sensor and air-fuel ratio regions of the engine, according to the first embodiment.

In FIG. 1, the control unit 1 constitutes a main portion of the engine control apparatus. The control unit 1 is constituted by a microcomputer having a CPU (not shown) and a memory 30. The control unit 1 stores programs and maps used to control an overall operation of an engine 19 in the memory 30.

An intake pipe 14 and an exhaust pipe 10 are provided in the engine 19. The intake pipe 14 introduces intake air A into the engine 19. The exhaust pipe 10 discharges exhaust gas Ah from the engine 19.

An intake air temperature sensor 2, a throttle valve 3, a throttle position sensor 4, an intake air pressure sensor 5, and a fuel injection module 8 are provided in the intake pipe 14.

The intake air temperature sensor 2 measures a temperature (an intake air temperature) Ta of the intake air A flowing through the intake pipe 14.

The throttle valve 3 is driven to open and close by a throttle actuator 4A. The throttle valve 3 adjusts an intake air amount of the intake air A.

The throttle position sensor 4 measures an opening θ of the throttle valve 3.

The intake air pressure sensor 5 measures an intake air pressure Pa downstream of the throttle valve 3.

The fuel injection module 8 includes an injector for injecting fuel into the engine 19.

An engine temperature sensor 6, a crank angle sensor 7, and a spark plug 9A are provided in the engine 19.

The engine temperature sensor 6 measures a wall surface temperature (an engine temperature) Tw of the engine 19.

The crank angle sensor 7 outputs an engine rotation speed Ne, and a crank angle signal SGT (a pulse) corresponding to a crank position. The spark plug 9A is driven by an ignition coil 9.

Note that the engine control apparatus according to the first embodiment can also be established by a system not including sensors such as the throttle position sensor 4, the intake air temperature sensor 2, and the engine temperature sensor 6.

An oxygen sensor 11 and a three-way catalytic converter (referred to simply hereafter as a "three-way catalyst") 12 are provided in the exhaust pipe 10.

The oxygen sensor 11 functions as an air-fuel ratio sensor. The oxygen sensor 11 outputs an oxygen sensor output value VO2 indicating a voltage value that corresponds to an oxygen concentration of the exhaust gas Ah discharged from the engine 19. In this embodiment, the oxygen sensor 11 is constituted by a configuration in which a platinum electrode is provided on each surface of a test tube-shaped zirconia element. Further, to protect the platinum electrodes, outer sides of the platinum electrodes are coated with ceramic using a property of the zirconia element. Here, the property of the zirconia element is that when an oxygen concentration difference exists between an inner surface and an outer surface at a high temperature, electromotive force is generated.

The three-way catalyst 12 purifies the exhaust gas Ah.

As shown in FIG. 3, the oxygen sensor output value VO2 from the oxygen sensor 11 varies in accordance with the oxygen concentration of the exhaust gas Ah.

In FIG. 3, the abscissa shows the air-fuel ratio and the ordinate shows the oxygen sensor output value VO2.

On the abscissa, an air-fuel ratio of 14.7 is the stoichiometric air-fuel ratio. Further, on the ordinate, a voltage value of 0.45 V is a voltage value indicating the stoichiometric air-fuel ratio. In other words, when the value of the oxygen sensor output value VO2 is 0.45 V, the air-fuel ratio is known to correspond to the stoichiometric air-fuel ratio.

In FIG. 3, a solid line 300 shows an output characteristic of the oxygen sensor output value VO2 in a case where a sensor element temperature of the oxygen sensor 11 is at a reference temperature Tst. Here, the reference temperature Tst is 700° C., for example. A dotted line 301 shows the output characteristic of the oxygen sensor output value VO2 in a case where the sensor element temperature of the oxygen sensor 11 is at a lower temperature than the reference temperature Tst. Here, the lower temperature is 500° C., for example.

A dot-dot-dash line 302 shows the output characteristic of the oxygen sensor output value VO2 in a case where the sensor element temperature of the oxygen sensor 11 is at a higher temperature than the reference temperature Tst. Here, the higher temperature is 900° C., for example.

As shown by the dotted line 301 in FIG. 3, when the sensor element temperature is 500° C., a voltage value indicating an air-fuel ratio of 13.5 is 0.80 V.

As shown by the solid line 300, when the sensor element temperature is 700° C., the voltage value indicating an air-fuel ratio of 13.5 is 0.75 V.

As shown by the dotted line 301, when the sensor element temperature is 500° C., a voltage value indicating an air-fuel ratio of 14.0 is 0.70 V. Further, as shown by the dot-dot-dash line 302, when the sensor element temperature is 900° C., the voltage value indicating an air-fuel ratio of 13.5 is likewise 0.70 V.

In this embodiment, a first determination voltage is set at 0.70 V on the basis of a case in which the sensor element temperature is 900° C.

As shown by the dotted line 301 in FIG. 3, when the sensor element temperature is 500° C., a voltage value indicating an air-fuel ratio of 15.2 is 0.20 V. Further, as shown by the dot-dot-dash line 302, when the sensor element temperature is 900° C., a voltage value indicating an air-fuel ratio of 15.5 is 0.20 V.

As shown by the solid line 300, when the sensor element temperature is 700° C., the voltage value indicating an air-fuel ratio of 15.5 is 0.15 V.

As shown by the dotted line 301, when the sensor element temperature is 500° C., the voltage value indicating an air-fuel ratio of 15.5 is 0.10 V.

In this embodiment, a second determination voltage is set at 0.20 V on the basis of a case in which the sensor element temperature is 900° C.

Note that in FIG. 3, an air-fuel ratio indicated by a voltage value of 0.80 V at 500° C., an air-fuel ratio indicated by a voltage value of 0.75 V at 700° C., and an air-fuel ratio indicated by a voltage value of 0.70 V at 900° C. are all 13.5.

Further, an air-fuel ratio indicated by a voltage value of 0.70 V at 500° C. is 14.0.

Furthermore, an air-fuel ratio indicated by a voltage value of 0.10 V at 500° C., an air-fuel ratio indicated by a voltage value of 0.15 V at 700° C., and an air-fuel ratio indicated by a voltage value of 0.20 V at 900° C. are all 15.5.

As shown in FIG. 3, the oxygen sensor output value VO2 [V] varies rapidly in the vicinity of the stoichiometric air-fuel ratio (=14.7). On a rich side of the stoichiometric air-fuel ratio, the electromotive force of the oxygen sensor 11 increases. On a lean side of the stoichiometric air-fuel ratio, meanwhile, the electromotive force of the oxygen sensor 11 decreases. Hence, the oxygen sensor output value VO2 [V] increases on the rich side and decreases on the lean side.

As described above, the sensor element of the oxygen sensor 11 exhibits a temperature characteristic. According to this characteristic, when the sensor element temperature is high, as shown by the dot-dot-dash line 302, an amount by which the oxygen sensor output value VO2 varies about the stoichiometric air-fuel ratio tends to decrease. When the sensor element temperature is low, as shown by the dotted line 301, on the other hand, the amount by which the oxygen sensor output value VO2 varies about the stoichiometric air-fuel ratio tends to increase.

Detection signals from the oxygen sensor 11 and the sensors 4, 6, 7 are input into the control unit 1 as operating condition information indicating operating conditions of the engine 19. The operating condition information includes at least one of the oxygen sensor output value VO2, the throttle opening θ, an engine temperature Tw, and the engine rotation speed Ne. If required, the intake air temperature Ta, the intake air pressure Pa, and the crank angle signal SGT may also be input from the sensors 2, 5, 7. On the basis of the operating condition information, the control unit 1 outputs drive signals to various actuators such as the throttle actuator 4A and the ignition coil 9.

Further, a display device 13 is provided in the control unit 1. The display device 13 displays a control condition of the engine 19, warning information, and so on to a driver of the vehicle.

The control unit 1 calculates an appropriate fuel injection timing and an appropriate fuel injection amount in relation to the intake pipe 14 on the basis of the operating condition information and the oxygen sensor output value VO2 from the oxygen sensor 11, and outputs a drive signal to the fuel injection module 8.

Further, the control unit 1 calculates an appropriate ignition timing on the basis of the operating condition information, and outputs an ignition signal to the ignition coil 9. The ignition coil 9 applies a high voltage required for spark discharge to the spark plug 9A on the basis of the ignition signal. As a result, an air-fuel mixture in a combustion chamber of the engine 19 undergoes explosive combustion.

The exhaust gas Ah from the engine 19 is discharged into the atmosphere from the exhaust pipe 10. The three-way catalyst 12 for purifying the exhaust gas is provided in the exhaust pipe 10. The three-way catalyst 12 is an effective device for reducing a plurality of harmful components contained in the exhaust gas Ah simultaneously. The three-way catalyst 12 performs an HC or CO oxidation reaction and a $NO_x$ reduction reaction simultaneously.

In the engine control apparatus according to the first embodiment, the oxygen sensor output value VO2 is not simply replaced with a specific air-fuel ratio. In the engine control apparatus according to the first embodiment, the air-fuel ratio is classified into four or more magnitude regions on the basis of the oxygen sensor output value VO2. Further, a gain used during air-fuel ratio feedback control is determined in accordance with the region in which the air-fuel ratio has been classified. A feedback control correction amount that is appropriate for the air-fuel ratio region of the engine 19 is then calculated using the gain obtained in this manner.

In accordance with the characteristic of the oxygen sensor 11, as shown in FIG. 3, when the air-fuel ratio is rich or lean, the oxygen sensor output value VO2 varies by a small amount in response to variation in the air-fuel ratio. When the air-fuel ratio is in the vicinity of the stoichiometric air-fuel ratio, however, the oxygen sensor output value VO2 varies by a large amount in response to variation in the air-fuel ratio. In other words, the oxygen sensor output value VO2 varies about a specific air-fuel ratio in the vicinity of the stoichiometric air-fuel ratio. The specific air-fuel ratio depends on the characteristics of the oxygen sensor 11, for example, but may be an air-fuel ratio of 13.5 on the rich side and 15.5 on the lean side, for example. Hence, in the first embodiment, attention will be focused on the fact that the rich side and the lean side can respectively be divided into two regions.

In this embodiment, therefore, as shown in FIG. 3, the air-fuel ratio is classified into the following four regions. Here, 14.7 is the stoichiometric air-fuel ratio.

In a first rich region R1, the air-fuel ratio is smaller than 13.5. In a second rich region R2, the air-fuel ratio is no smaller than 13.5 and smaller than 14.7.

In a second lean region R3, the air-fuel ratio is no smaller than 14.7 and smaller than 15.5.

In a first lean region R4, the air-fuel ratio is equal to or larger than 15.5.

As shown in FIG. 3, when the sensor element temperature of the oxygen sensor 11 is high, the oxygen sensor output value VO2 shifts to the rich side. When the sensor element temperature of the oxygen sensor 11 is 500 degrees, as shown by the dotted line 301 in FIG. 3, for example, the voltage value at which the oxygen sensor output value VO2 varies rapidly relative to the air-fuel ratio is 0.80 V. When the sensor element temperature of the oxygen sensor 11 is 900 degrees, as shown by the dot-dot-dash line 302 in FIG. 3, on the other hand, the voltage value at which the oxygen sensor output value VO2 varies rapidly relative to the air-fuel ratio is 0.7 V.

When the sensor element temperature varies while the oxygen sensor output value VO2 remains constant, the air-fuel ratio shifts steadily in a rich direction as the sensor element temperature increases. When the oxygen sensor output value VO2 is 0.7 V, for example, the air-fuel ratio at a sensor element temperature of 500 degrees is 14.0, as shown by the dotted line 301 in FIG. 3, whereas the air-fuel ratio at a sensor element temperature of 900 degrees is 13.5, as shown by the dot-dot-dash line 302 in FIG. 3.

Hence, on the basis of the characteristic of the oxygen sensor output value VO2 at a maximum value (900° C., for example) of the sensor element temperature that can be envisaged from the usage environment of the vehicle, the voltage values at which the oxygen sensor output value VO2 varies rapidly are set as the first determination voltage (0.70 V, for example) and the second determination voltage (0.20 V, for example). The air-fuel ratio is then classified into the four regions in accordance with the oxygen sensor output value VO2 using the voltage value (0.45 V, for example) indicating the stoichiometric air-fuel ratio, the first determination voltage, and the second determination voltage. As a result, as shown in FIG. 3, air-fuel ratios included in the first rich region R1 are richer than at least 13.5, regardless of the sensor element temperature. Further, air-fuel ratios included in the second rich region R2 are between the stoichiometric air-fuel ratio (an air-fuel ratio of 14.7) and 13.5. Likewise on the lean side, from the relationship between the second determination voltage and the air-fuel ratio at the respective sensor element temperatures, air-fuel ratios included in the first lean region R4 are leaner than at least 15.5, while air-fuel ratios included in the second lean region R3 are between the stoichiometric air-fuel ratio (an air-fuel ratio of 14.7) and 15.5.

By classifying the air-fuel ratio into four regions in accordance with the oxygen sensor output value VO2, an air-fuel ratio feedback gain can be calculated for each air-fuel ratio region. For example, absolute values of the air-fuel ratio feedback gains of the first rich region R1 and the first lean region R4 can be made larger than absolute values of the air-fuel ratio feedback gains of the second rich region R2 and the second lean region R3.

In the engine control apparatus according to the first embodiment, as described above, the air-fuel ratio condition of the engine 19 is classified into at least four regions, namely the first rich region R1, the second rich region R2, the first lean region R4, and the second lean region R3, in accordance with the oxygen sensor output value VO2.

The control unit 1 compares the oxygen sensor output value VO2 with the first determination voltage. The control unit 1 then makes following determinations.

(1) When the oxygen sensor output value VO2 equals or exceeds the first determination voltage, the air-fuel ratio is determined to be in the first rich region R1.

(2) When the oxygen sensor output value VO2 equals or exceeds the voltage value indicating the stoichiometric air-fuel ratio but is lower than the first determination value, the air-fuel ratio is determined to be in the second rich region R2.

(3) When the oxygen sensor output value VO2 is lower than the second determination value, the air-fuel ratio is determined to be in the first lean region R4.

(4) When the oxygen sensor output value VO2 is lower than the voltage value indicating the stoichiometric air-fuel ratio but equals or exceeds the second determination value, the air-fuel ratio is determined to be in the second lean region R3.

Next, using FIG. 2, an interior configuration of the control unit 1 of the engine control apparatus according to the first embodiment will be described.

In FIG. 2, a sensor group 15 includes the respective sensors 2 and 4 to 7 shown in FIG. 1. The operating condition information from the sensor group 15 includes at least one of the engine rotation speed Ne, the throttle opening θ, and the engine temperature Tw. The operating condition information is input into the control unit 1. If necessary, the operating condition information may also include the intake air temperature Ta, the intake air pressure Pa, and the crank angle signal SGT. The oxygen sensor 11 inputs the oxygen sensor output value VO2 into the control unit 1.

The control unit 1 includes, in addition to an ignition timing control unit (not shown) that controls an ignition timing, an air-fuel ratio feedback control unit 20 shown in FIG. 2. The ignition timing control unit is not a main feature of this invention, and will not therefore be described specifically in this embodiment. The control unit 1 adjusts an amount of fuel injected into the engine 19 on the basis of the operating condition information from the sensor group 15 and the oxygen sensor output value VO2 from the oxygen sensor 11. The control unit 1 exchanges various information with the memory 30, which includes a non-volatile memory 27.

The air-fuel ratio feedback control unit 20 provided in the control unit 1 performs air-fuel ratio feedback control such that the oxygen sensor output value VO2 matches a voltage value (a target voltage≅0.45 V) VO2*t* indicating the stoichiometric air-fuel ratio.

The air-fuel ratio feedback control unit 20 includes an air-fuel ratio region detection unit 21, a proportional gain calculation unit 22, an integral gain calculation unit 23, a control correction amount calculation unit 24, and a fuel injection driving unit 25.

The air-fuel ratio region detection unit 21 determines the air-fuel ratio of the engine 19 from the oxygen sensor output value VO2. More specifically, the air-fuel ratio region detection unit 21 determines the region to which the current air-fuel ratio of the engine 19 belongs, among the four or more divided regions, on the basis of the oxygen sensor output value VO2 from the oxygen sensor 11, the target voltage VO2*t*, and the first and second determination voltages. The four or more regions are set by dividing the rich side of the stoichiometric air-fuel ratio into at least two regions and dividing the lean side of the stoichiometric air-fuel ratio into at least two regions. The two or more regions on the rich side include a region in which the oxygen sensor output value VO2 increases gently and a region in which the oxygen sensor output value VO2 increases rapidly. On the rich side, a rate of change (an incline on a graph) of the oxygen sensor output value VO2 varies rapidly from a certain air-fuel ratio value (13.5 in FIG. 3), and therefore the rich side is divided into two regions about this air-fuel ratio value. Similarly, the two or more regions on the lean side include a region in which the oxygen sensor output value VO2 decreases gently and a region in which the oxygen sensor output value VO2 decreases rapidly. In this embodiment, for example, the rich side includes the first region R1 and the second rich region R2, while the lean side includes the first lean region R4 and the second lean region R3. On the lean side, the rate of change (the incline on a graph) of the oxygen sensor output value VO2 varies rapidly from a certain air-fuel ratio value (15.5 in FIG. 3), and therefore the lean side is divided into two regions about this air-fuel ratio value.

A proportional gain switch unit (not shown) and a proportional gain map (see FIG. 5A) are provided in the proportional gain calculation unit 22. The proportional gain calculation unit 22 calculates a proportional gain Gp1 corresponding to a proportional term of the air-fuel ratio feedback control. The proportional gain Gp1 is set for each of the air-fuel ratio regions of the engine 19, and stored in advance on the proportional gain map. The proportional gain calculation unit 22 obtains the corresponding proportional gain Gp1 from the proportional gain map on the basis of the air-fuel ratio region of the engine 19, determined by the air-fuel ratio region detection unit 21. The proportional gain calculation unit 22 uses the proportional gain switch unit to update the current proportional gain to the proportional gain obtained from the map. The proportional gain calculation unit 22 is also capable of correcting the proportional gain Gp on the basis of the rotation speed Ne of the engine 19, the throttle opening θ, and the intake air pressure Pa using the information from the sensor group 15.

An integral gain switch unit (not shown) and an integral gain map (see FIG. 6A) are provided in the integral gain calculation unit 23. The integral gain calculation unit 23 calculates an integral gain Gi corresponding to an integral term of the air-fuel ratio feedback control. The integral gain Gi is stored in advance on the integral gain map for each of the air-fuel ratio regions of the engine 19. The integral gain calculation unit 23 obtains the corresponding integral gain Gi from the integral gain map on the basis of the air-fuel ratio region of the engine 19, determined by the air-fuel ratio region detection unit 21. The integral gain calculation unit 23 uses the integral gain switch unit to update the current integral gain to the obtained integral gain. The integral gain calculation unit 23 is also capable of correcting the integral gain Gi on the basis of the rotation speed Ne of the engine 19, the throttle opening θ, and the intake air pressure Pa using the information from the sensor group 15.

The control correction amount calculation unit 24 calculates an air-fuel ratio feedback control correction amount Kfb on the basis of at least one of the proportional gain Gp and the integral gain Gi using preset calculation formulae (Equations (1) and (2) to be described below, for example). As a result, the oxygen sensor output value VO2 undergoes air-fuel ratio feedback control so as to match the voltage value (the target voltage≅0.45 V) VO2*t* indicating the stoichiometric air-fuel ratio.

The fuel injection driving unit 25 drives the fuel injection module 8 on the basis of the air-fuel ratio feedback control correction amount Kfb.

An operation of the air-fuel ratio feedback control unit 20 will be described in detail below with reference to FIGS. 1 to 3, a flowchart shown in FIG. 4, and illustrative views shown in FIGS. 5 and 6.

Figure 4:
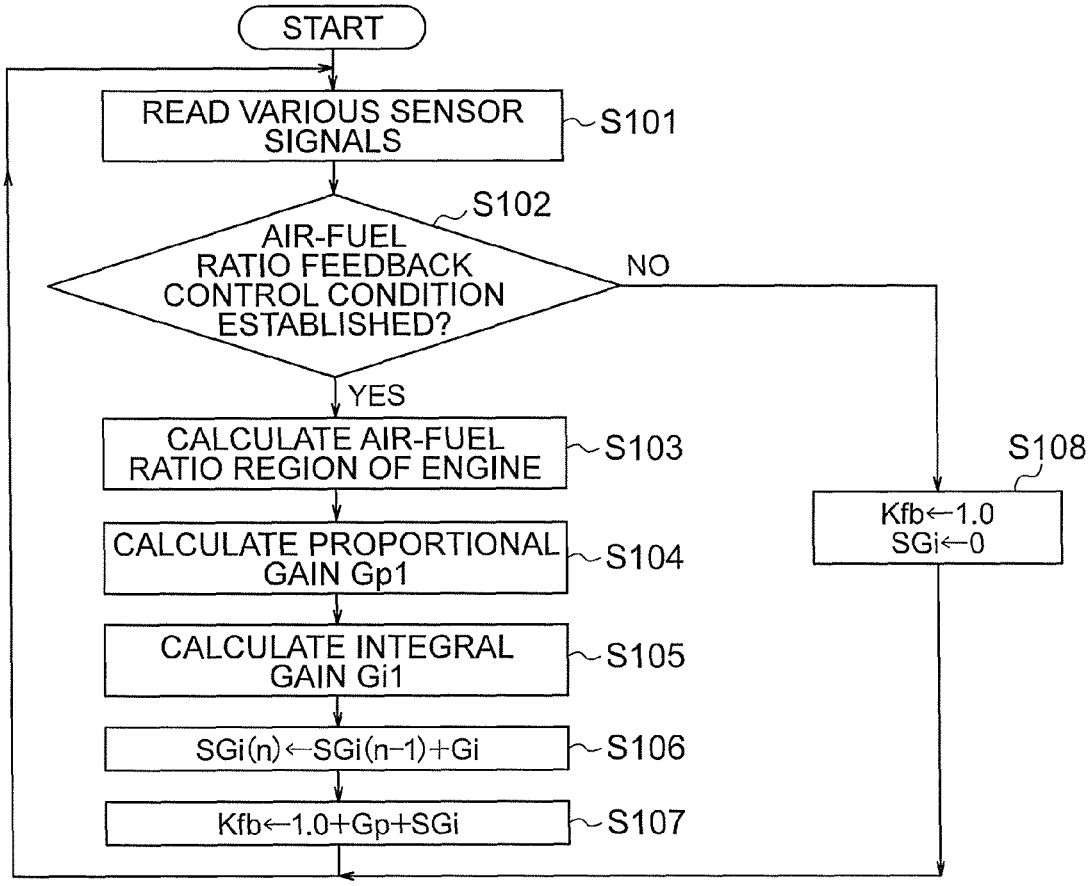
FIG. 4 is a flowchart showing an operation of an air-fuel ratio feedback control unit according to the first embodiment of this invention.

In FIG. 4, first, in step S101, the air-fuel ratio feedback control unit 20 reads the operating condition information indicating the operating conditions of the engine 19 from the various sensors. In other words, the air-fuel ratio feedback control unit 20 reads the operating condition information from the oxygen sensor 11 and the sensor group 15 connected to the control unit 1. The sensor group 15 includes the intake air temperature sensor 2, the throttle position sensor 4, the intake air pressure sensor 5, the engine temperature sensor 6, and the crank angle sensor 7. However, the operating condition information does not have to include all of the operating condition information from these sensors.

Next, in step S102, the air-fuel ratio feedback control unit 20 determines on the basis of the operating condition information of the engine whether or not an air-fuel ratio feedback control condition is established. The air-fuel ratio feedback control condition is established when, for example, "the oxygen sensor 11 is activated", "the oxygen sensor 11 is not broken", "a fuel cut is not underway", and so on. A determination as to whether or not the oxygen sensor 11 is activated can be made by comparing the oxygen sensor output value with a preset activation determination threshold. Note, however, that the activation determination threshold differs according to the type of the oxygen sensor and an oxygen sensor input circuit of the control unit. Further, depending on the type of the oxygen sensor and the oxygen sensor input circuit of the control unit, the oxygen sensor 11 may be determined to be activated either when the oxygen sensor output value is higher than the threshold or when the oxygen sensor output value is lower than the threshold. Hence, a specific determination threshold at which to determine that "the oxygen sensor 11 is activated" is set appropriately in accordance with the type of the oxygen sensor and the oxygen sensor input circuit of the control unit.

When, as a result of the determination of step S102, the air-fuel ratio feedback control condition is established, the processing advances to step S103. When the air-fuel ratio feedback control condition is not established, on the other hand, the processing advances to step S108.

In step S108, the air-fuel ratio feedback control correction amount Kfb is set at 1.0 and a sum SGi of the integral gain is set at 0. The processing then returns to step S101, whereupon the routine is repeated.

In step S103, meanwhile, the air-fuel ratio feedback control unit 20 uses the air-fuel ratio region detection unit 21 to determine, on the basis of the oxygen sensor output value VO2, the air-fuel ratio region to which the air-fuel ratio of the engine 19 belongs, among the four or more air-fuel ratio regions.

More specifically, as shown in FIG. 3, the air-fuel ratio regions of the engine are determined on the basis of the relationship of the oxygen sensor output value VO2 to the first determination voltage, the second determination voltage, and the target voltage VO2*t*. Note that here, the target voltage VO2*t* is the voltage value indicating the stoichiometric air-fuel ratio. The target voltage VO2*t* is 0.45 V, for example.

The first determination voltage and the second determination voltage are recorded in the memory 30 of the control unit 1 in advance. The first determination voltage and the second determination voltage are determined by determining, through experiment, the voltage values of the subject oxygen sensor 11 at which the rate of change in the oxygen sensor output value VO2 varies rapidly relative to the air-fuel ratio when the sensor element temperature of the oxygen sensor is high. A temperature variation range of the sensor element temperature of the oxygen sensor 11 may be envisaged from the actual usage environment and operating conditions of the engine 19. The first determination voltage is higher than the target voltage VO2*t*, and the second determination voltage is lower than the target voltage VO2*t*. Here, the first determination voltage is set at 0.70 V, and the second determination voltage is set at 0.20 V.

As indicated by an air-fuel ratio determination voltage updating unit 21*c* according to a modified example of the first embodiment shown in FIG. 8, to be described below, the first determination voltage and the second determination voltage may be updated to optimum determination voltages for the sensor element temperature on the basis of an estimation result of the sensor element temperature of the oxygen sensor 11.

As described above, the air-fuel ratio region detection unit 21 determines the air-fuel ratio region to which the current air-fuel ratio of the engine 19 belongs as follows.

When the oxygen sensor output value VO2 the first determination voltage, the air-fuel ratio region of the engine 19 is determined to be the first rich region R1.

When the target voltage VO2*t* the oxygen sensor output value VO2<the first determination voltage, the air-fuel ratio region of the engine 19 is determined to be the second rich region R2. When the oxygen sensor output value VO2<the second determination voltage, the air-fuel ratio region of the engine 19 is determined to be the first lean region R4.

When the second determination voltage≤the oxygen sensor output value VO2<the target voltage VO2*t*, the air-fuel ratio region of the engine 19 is determined to be the second lean region R3.

Between the first rich region R1 and the second rich region R2, the air-fuel ratio is smaller in the first rich region R1 than in the second rich region R2. Further, between the first lean region R4 and the second lean region R3, the air-fuel ratio is larger in the first lean region R4 than in the second lean region R3. In other words, the respective air-fuel ratio regions indicate the degree of richness and the degree of leanness.

Note that when the air-fuel ratio is classified into more than four regions, a third determination voltage, a fourth determination voltage, and so on may be added.

In step S104, the air-fuel ratio feedback control unit 20 uses the proportional gain calculation unit 22 to calculate the proportional gain Gp1. Next, the air-fuel ratio feedback control unit 20 uses the integral gain calculation unit 23 to calculate the integral gain Gi1 in step S105. In the air-fuel ratio feedback control according to the first embodiment, proportional/integral (PI) feedback having a proportional gain and an integral gain is used in each of the air-fuel ratio regions of the engine 19 determined in step S103 to cause the oxygen sensor output value VO2 to converge on the target voltage VO2*t*.

A method employed in step S104 to determine the proportional gain will now be described.

The proportional gain of feedback control is typically used to correct an output value in proportion with a deviation between a target value and a current value of a control subject. In the air-fuel ratio feedback control according to the first embodiment, however, the proportional gain Gp1 is calculated from the proportional gain map shown in FIG. 5A using the air-fuel ratio region of the engine 19 as an axis. On the proportional gain map, the proportional gain Gp1 is set in advance for each air-fuel ratio region of the engine 19.

More specifically, when the air-fuel ratio region of the engine 19 is the first rich region R1 or the first lean region R4, the oxygen sensor output value VO2 deviates greatly from the target voltage VO2*t*. Therefore, given that the air-fuel ratio deviation is large, an absolute value of the proportional gain in the first rich region R1 and the first lean region R4 is larger than the absolute value of the proportional gain in the second rich region R2 and the second lean region R3.

When the air-fuel ratio region of the engine 19 is the second rich region R2 or the second lean region R3, the oxygen sensor output value VO2 is close to the target voltage VO2*t*. Therefore, given that the air-fuel ratio deviation is small, the absolute value of the proportional gain in the second rich region R2 and the second lean region R3 is smaller than the absolute value of the proportional gain in the first rich region R1 and the first lean region R4. The proportional gain Gp1 is set on the proportional gain map in this manner for each of the air-fuel ratio regions of the engine 19. The proportional gain Gp1 is set through experiment by envisaging the deviation between the oxygen sensor output value VO2 and the target voltage VO2*t* in each air-fuel ratio region of the engine 19.

The proportional gain map generated in this manner is stored in advance in the memory 30. The proportional gain calculation unit 22 obtains the corresponding proportional gain Gp1 from the proportional gain map on the basis of the air-fuel ratio region determined in step S103.

Note that the exhaust gas reaches the oxygen sensor 11 at different times depending on the rotation speed and the load of the engine 19. Therefore, a correction may be applied to the proportional gain in accordance with the rotation speed and the load of the engine 19 so that the proportional gain is corrected to an optimum proportional gain in accordance with the operating conditions of the engine 19.

A method employed in step S105 to determine the integral gain will now be described.

The integral gain of feedback control is typically used to correct the output value in proportion with an integrated deviation between the target value and the current value of the control subject. In the air-fuel ratio feedback control according to the first embodiment, however, the integral gain Gi1 is calculated from an integral gain map shown in FIG. 6A using the air-fuel ratio region of the engine 19 as an axis. On the integral gain map, the integral gain Gi1 is set in advance for each air-fuel ratio region of the engine 19.

Note that the method of setting the integral gain Gi1 is identical to the method of setting the proportional gain Gp1, described above, and therefore an absolute value of the integral gain in the first rich region R1 and the first lean region R4 is set to be larger than the absolute value of the integral gain in the second rich region R2 and the second lean region R3.

Further, similarly to the proportional gain, the integral gain may be corrected in accordance with the operating conditions of the engine 19.

Note that here, the proportional gain calculation unit 22, the integral gain calculation unit 23, and the control correction amount calculation unit 24 together constitute an air-fuel ratio feedback control correction amount calculation unit that calculates a first feedback control correction amount for setting the gain of the air-fuel ratio feedback control in accordance with the air-fuel ratio region of the engine 19, detected by the air-fuel ratio region detection unit 21.

Here, the first feedback control correction amount is the air-fuel ratio feedback control correction amount Kfb calculated from the proportional gain Gp1 and the integral gain Gi1.

In step S106, a sum SGi (n) of the integral gain Gi1 is calculated using the integral gain Gi1 obtained in step S105 in accordance with Equation (1), shown below, whereupon the processing advances to step S107. Note that the integral gain Gi1 is inserted into Gi in Equation (1).

$$SGi(n)=SGi(n-1)+Gi \tag{1}$$

Here, SGi (n) is the current sum of the integral gain Gi1, and SGi (n−1) is the previous sum of the integral gain Gi1.

The operation performed in step S106 corresponds to an integration operation performed on the deviation of the control subject during typical feedback control, where the integral gain itself serves as the deviation of the control subject. This method is in wide general use as a simplified feedback control method suitable for feedback-controlling the air-fuel ratio of a motorcycle.

Next, in step S107, the air-fuel ratio feedback control correction amount Kfb is calculated using the sum SGi (n) of the integral gain Gi1, determined in step S106, in accordance with Equation (2), shown below, whereupon the processing returns to step S101 so that the routine can be repeated. Note that Gp1 obtained in step S105 is input into Gp in Equation (2).

$$Kfb=1.0+Gp+SGi(n) \tag{2}$$

After calculating the air-fuel ratio feedback control correction amount Kfb in the manner described above, the air-fuel ratio feedback control correction amount Kfb is input into the fuel injection driving unit 25.

According to the first embodiment, as described above, the air-fuel ratio of the engine 19 is classified as one of four or more regions on the basis of the oxygen sensor output value VO2 from the oxygen sensor 11, whereupon optimum proportional and integral gains for the air-fuel ratio feedback control are selected in accordance with the air-fuel ratio region. As a result, convergence on the target voltage can be achieved more quickly than with the binary-based (i.e. based on whether the air-fuel ratio is richer or leaner than the stoichiometric air-fuel ratio) air-fuel ratio feedback control that is currently used widely. Further, in the first embodiment, the first and second determination voltages used to classify the air-fuel ratio of the engine 19 are set in consideration of whether the sensor element temperature of the oxygen sensor 11 is high or low. Hence, there is no need to estimate the sensor element temperature of the oxygen sensor 11 while the engine 19 is operative, and therefore the air-fuel ratio feedback control can be implemented even by an inexpensive, low-performance CPU.

Although there is no need to estimate the sensor element temperature of the oxygen sensor 11 in the first embodiment, as described above, when it is possible to estimate the sensor element temperature, the oxygen sensor output value VO2 can be used even more effectively. Advantages of estimating the sensor element temperature will be described below.

The first determination voltage and second determination voltage of the first embodiment are determined on the basis of the voltage values at which the rate of change in the oxygen sensor output value VO2 varies rapidly relative to the air-fuel ratio when the sensor element temperature of the oxygen sensor 11 is high within the range of the actual usage environment of the engine 19. When the sensor element temperature is not estimated, the second rich region R2 and the second lean region R3 among the air-fuel ratio regions of the engine 19 are in actuality limited to air-fuel ratio regions that also take into account a case in which the sensor element temperature of the oxygen sensor 11 is low. More specifically, as shown in FIG. 3, in a case where the first determination voltage is 0.7 V, for example, the air-fuel ratio corresponds to 13.5 when the sensor element temperature is high, but corresponds to 14.0 when the sensor element temperature is low. Therefore, the air-fuel ratios indicating the second rich region R2 of the air-fuel ratio regions of the engine 19 are limited to a range extending from the stoichiometric air-fuel ratio (=14.7) to 14.0. Likewise on the lean side, the air-fuel ratios indicating the second lean region R3 are limited to a narrow range. In this case also, the proportional gain and the integral gain of the air-fuel ratio feedback control can be set at optimum values, and therefore convergence of the oxygen sensor voltage on the target voltage can be achieved quickly. However, when the air-fuel ratio ranges of the second rich region R2 and the second lean region R3 are narrow, the air-fuel ratio of the engine 19 is frequently determined to be within the first rich region R1 or the first lean region R4 during an actual engine operation. As a result, it may be difficult to set the proportional gain and the integral gain of the air-fuel ratio feedback control at large values in the first rich region R1 and the first lean region R4.

Therefore, the sensor element temperature is estimated, whereupon the first determination voltage and the second determination voltage are updated in accordance with the sensor element temperature. In so doing, the respective air-fuel ratio ranges of the second rich region R2 and the second lean region R3 among the air-fuel ratio regions of the engine 19 can be widened.

Figure 7:
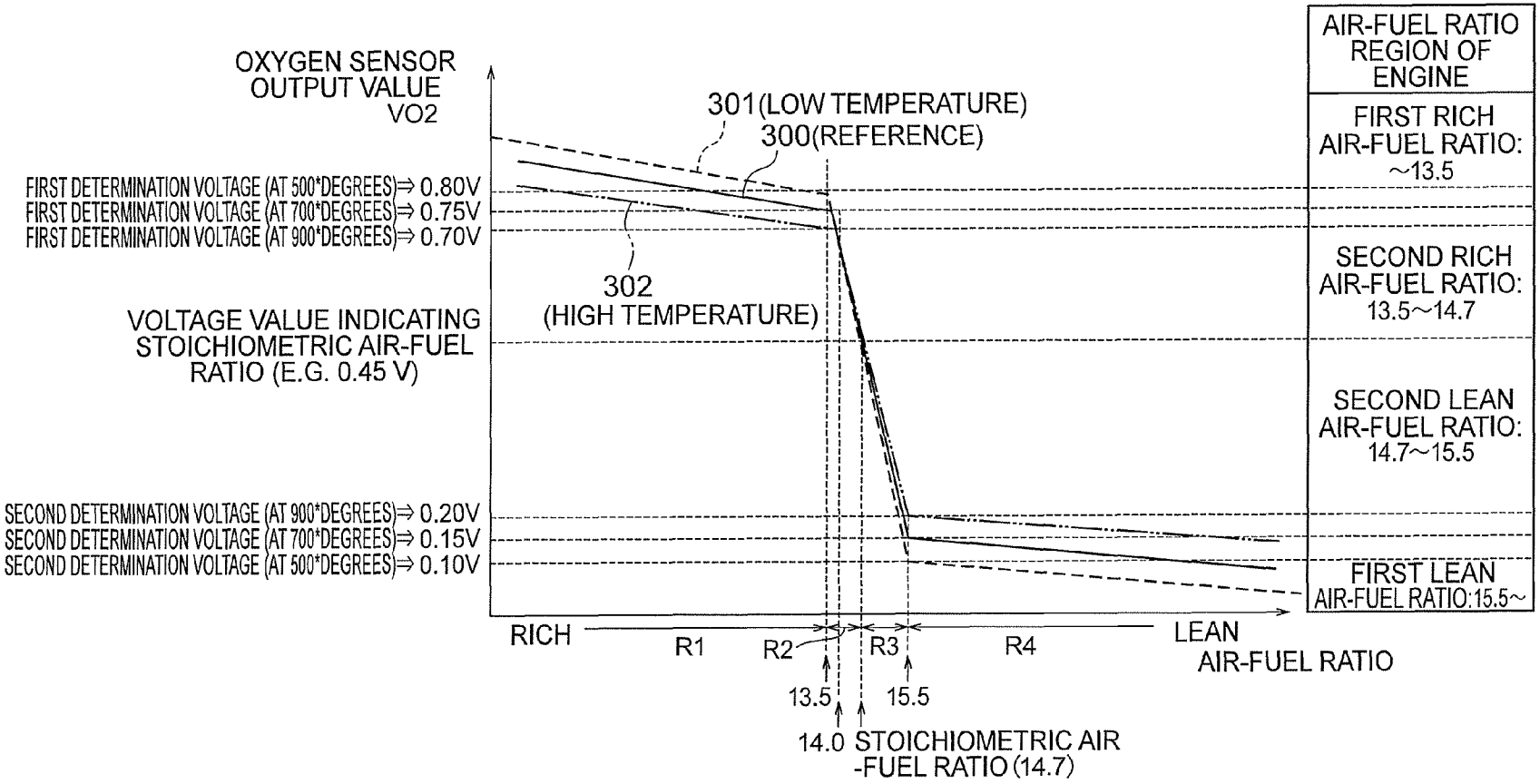
FIG. 7 is an illustrative view showing the output characteristic of the oxygen sensor and the air-fuel ratio regions of the engine used in the modified example of the first embodiment of this invention.

More specifically, as shown in FIG. 7, when the sensor element temperature of the oxygen sensor 11 is high, the first determination voltage is set at 0.7V (corresponding to an air-fuel ratio of 13.5), for example, and when the sensor element temperature is low, the first determination voltage is updated to 0.80 V, i.e. the voltage value corresponding to an air-fuel ratio of 13.5. As a result, the air-fuel ratio indicated by the first determination voltage remains at 13.5 at all times, regardless of the sensor element temperature. In this case, the air-fuel ratio range of the second rich region R2 is widened to a range extending from the stoichiometric air-fuel ratio (=14.7) to 13.5, and therefore the air-fuel ratio feedback gains of the first rich region R1 can be set at larger values than those of the first embodiment, described above. As a result, convergence on the target voltage can be improved.

However, when an inexpensive CPU such as that used in a motorcycle is employed, it is difficult to estimate the sensor element temperature of the oxygen sensor 11 accurately. Therefore, when the first determination voltage and second determination voltage are updated on the basis of the estimation result of the sensor element temperature and an error occurs in the estimation result of the sensor element temperature, the convergence performance of the air-fuel ratio feedback control may deteriorate.

To reduce this risk, it is effective to implement air-fuel ratio feedback control based on the air-fuel ratio region of the engine 19 only when the operating conditions of the engine 19 indicate a transient operation, and to implement binary-based air-fuel ratio feedback control, i.e. feedback control based on whether the air-fuel ratio is richer or leaner than the stoichiometric air-fuel ratio, when the operating conditions of the engine 19 indicate a steady state operation.

In a case where the air-fuel ratio of the engine 19 is very rich or very lean, intake air may be introduced rapidly into the engine 19 when the vehicle accelerates, leading to a deficiency in the fuel injection amount. When the vehicle decelerates, meanwhile, the amount of intake air may decrease, causing the fuel injection amount to become excessive. Hence, the large air-fuel ratio feedback gains obtained when the air-fuel ratio region of the engine 19 is classified as the first rich region R1 or the first lean region R4 are effective for improving convergence on the target voltage of the oxygen sensor 11. By employing air-fuel ratio feedback control based on the air-fuel ratio region of the engine 19 only when the engine 19 is in a transient operating condition, situations in which the convergence performance of the air-fuel ratio feedback control deteriorates can be limited even when an estimation error occurs in the sensor element temperature such that the gains of the air-fuel ratio feedback control are not optimal.

This modified example of the first embodiment of the invention will be described below with reference to FIGS. 7 to 10.

An overall configuration of the engine control apparatus according to this modified example is as shown in FIG. 1. The control unit 1 employs a configuration shown in FIG. 8 rather than the configuration shown in FIG. 2.

Figure 8:
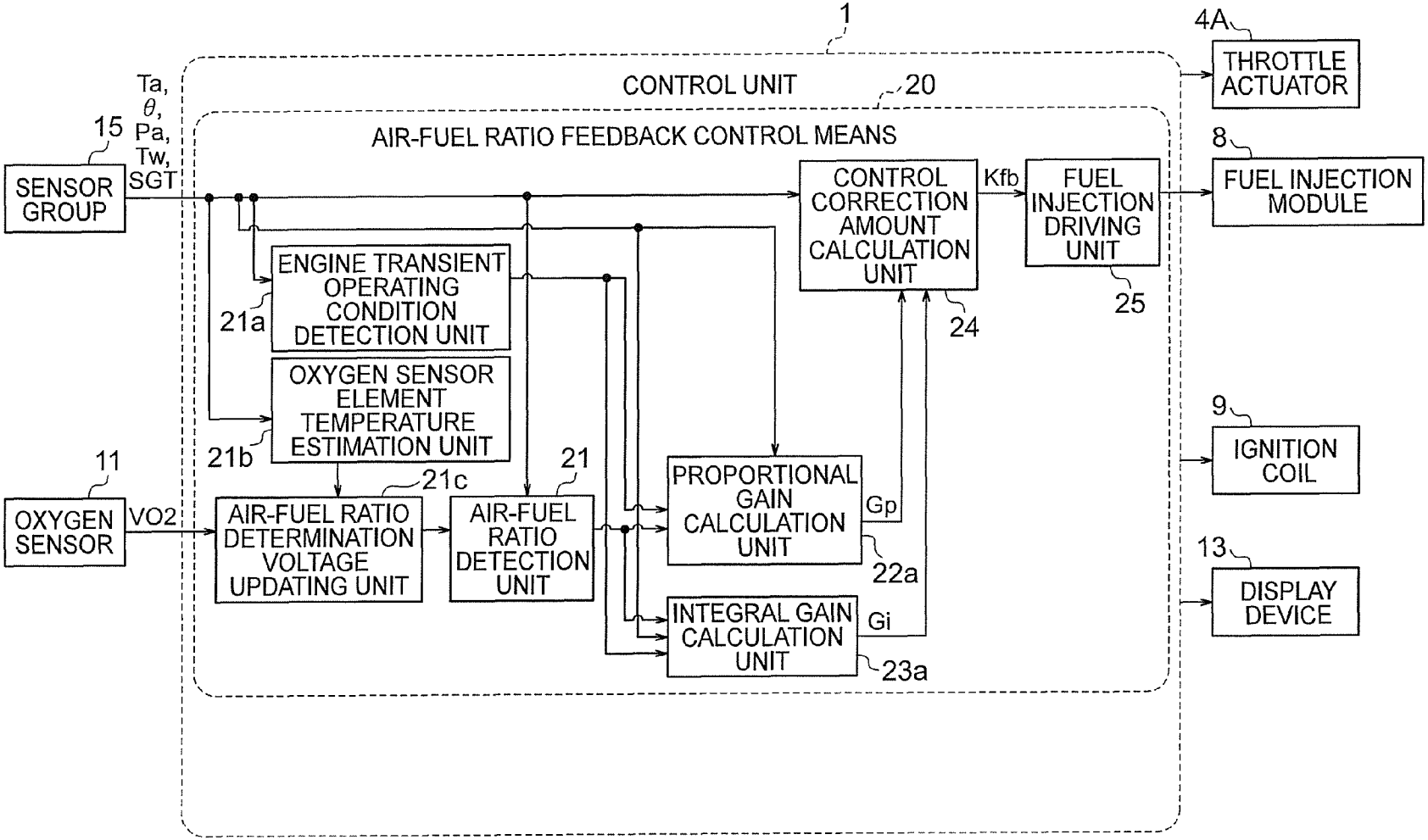
FIG. 8 is a block diagram showing the functional configuration of the engine control apparatus according to the modified example of the first embodiment of this invention.

FIG. 2 and FIG. 8 differ from each other in that in FIG. 8, an engine transient operating condition detection unit 21*a*, an oxygen sensor element temperature estimation unit 21*b*, and an air-fuel ratio determination voltage updating unit 21*c* are added to the configuration shown in FIG. 2. FIG. 8 also differs from FIG. 2 in that processing for switching the proportional gain and the integral gain in accordance with the transient operating condition of the engine 19 is added to FIG. 8.

The engine transient operating condition detection unit 21*a* determines whether the engine 19 is in the transient operating condition or the steady state operating condition on the basis of at least one of the engine rotation speed Ne, the throttle opening θ, and the intake air pressure Pa.

The oxygen sensor element temperature estimation unit 21*b* estimates the sensor element temperature of the oxygen sensor 11 on the basis of the engine rotation speed Ne and the throttle opening θ.

The air-fuel ratio determination voltage updating unit 21*c* determines on the basis of the estimated temperature of the sensor element of the oxygen sensor 11 whether or not a determination voltage updating condition is established, and when the determination voltage updating condition is established, updates the first determination voltage and second determination voltage for determining the air-fuel ratio region of the engine 19. Note that when the estimated temperature of the sensor element is higher than a threshold, the first determination voltage and second determination voltage are reduced below current values, and when the estimated temperature of the sensor element is equal to or lower than the threshold, the first determination voltage and second determination voltage are increased above the current values.

All other configurations are identical to FIG. 2, and will not therefore be described here.

Figure 9:
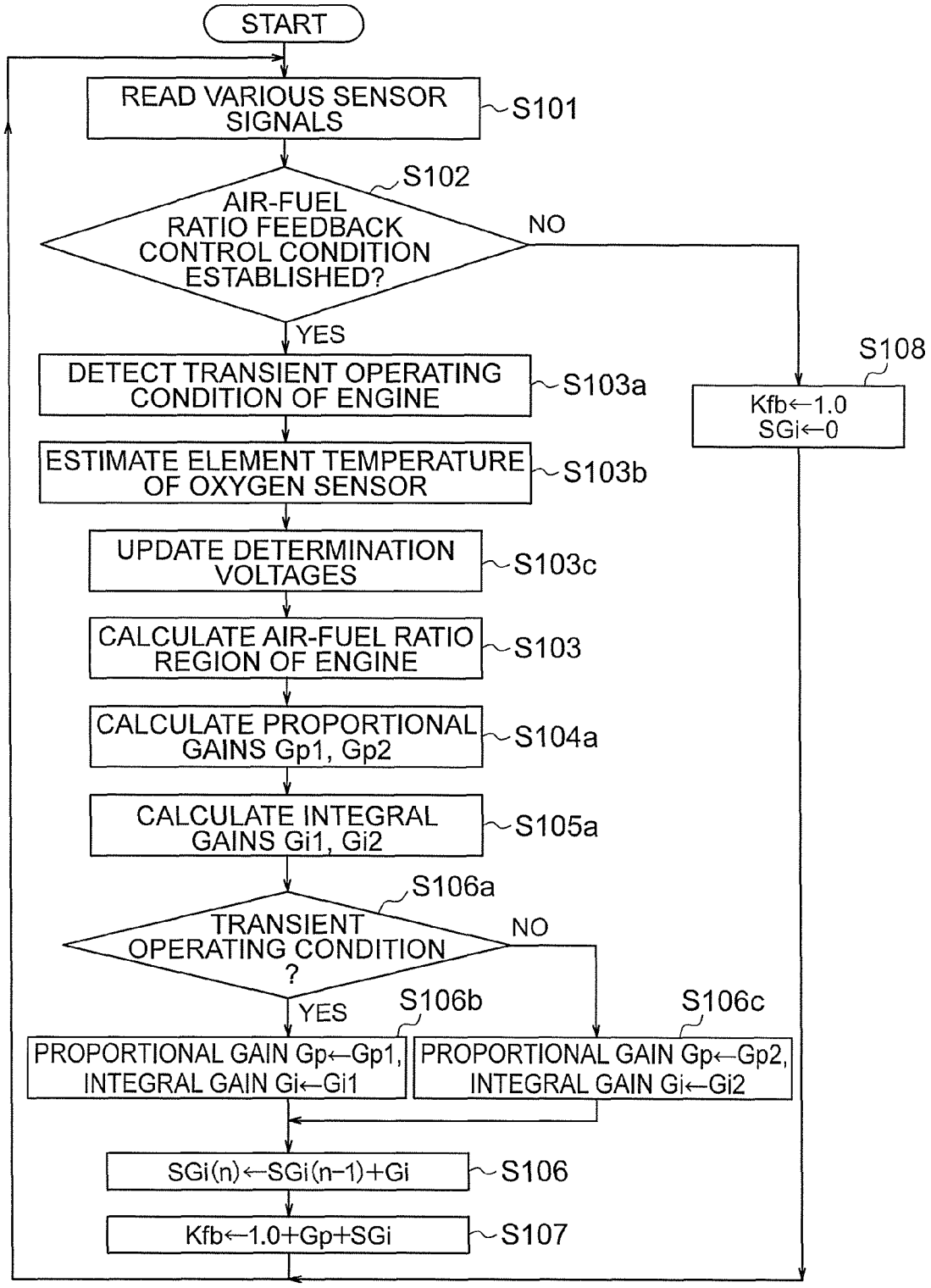
FIG. 9 is a flowchart showing an operation of the air-fuel ratio feedback control unit according to the modified example of the first embodiment of this invention.

FIG. 9 is a flowchart showing calculation processing performed by the air-fuel ratio feedback control unit according to this modified example. FIG. 9 differs from the flowchart shown in FIG. 4, described above, in the addition of a step for detecting the transient operating condition of the engine 19 (S103*a*), a step for estimating the sensor element temperature of the oxygen sensor 11 (S103*b*), a step for updating the first determination voltage and second determination voltage (S103*c*), and processing for switching the proportional gain and the integral gain in accordance with the transient operating condition of the engine 19 (S104*a*, S105*a*). Here, only these additional steps will be described.

Note that when step numbers in the flowchart of FIG. 9 are identical to the step numbers in the flowchart in FIG. 4, identical operations are performed in those steps.

In step S103*a*, the engine transient operating condition detection unit 21*a* determines, on the basis of signals from the sensor group 15, whether or not the engine 19 is in the transient operating condition, which corresponds to an acceleration operating condition or a deceleration operating condition. The determination as to whether or not the engine 19 is in the transient operating condition is made by determining whether or not one or a combination of two or more of the following three conditions is established: (1) an amount of variation in the engine rotation speed Ne equals or exceeds a threshold; (2) an amount of variation in the throttle opening θ equals or exceeds a threshold; and (3) an amount of variation in the intake air pressure Pa equals or exceeds a threshold. In other words, when the determination is made using one of the three conditions, the condition is selected from the three conditions in advance, and when the condition is established, the engine 19 is determined to be in the transient operating condition. Alternatively, the engine 19 is determined to be in the transient operating condition when any one of the three conditions is established. When the determination is made using a combination of two or more of the conditions, the two or more conditions are selected in advance from the three conditions, and when all of the two or more conditions are established, the engine 19 is determined to be in the transient operating condition. Alternatively, the engine 19 is determined to be in the transient operating condition when any two or more of the three conditions are established.

In step S103*b*, the oxygen sensor element temperature estimation unit 21*b* estimates/calculates a sensor element temperature Toe of the oxygen sensor 11 using an oxygen sensor basic map based on the engine rotation speed Ne and the throttle opening θ. FIG. 10A shows an example of the oxygen sensor basic map. The oxygen sensor basic map is a three-dimensional map having the engine rotation speed Ne and the throttle opening θ as axes. Values of the sensor element temperature Toe are set in advance on the oxygen sensor basic map in association with the engine rotation speed Ne and the throttle opening θ.

Note that the oxygen sensor basic map is not limited to the example shown in FIG. 10A, and as shown in FIG. 10B, the intake air pressure Pa may be used instead of the throttle opening θ.

Instead of estimating/calculating the sensor element temperature Toe from the map shown in FIG. 10A or FIG. 10B, a temperature sensor may be attached to the oxygen sensor 11 so that the sensor element temperature is measured directly. When the sensor element temperature is measured directly, the processing skips step S103*b* and advances to step S103*c*.

A method of estimating/calculating the sensor element temperature Toe in step S103*b* will now be described.

First, an estimated basic sensor temperature Toeb serving as a basic value of the sensor element temperature Toe is calculated on the basis of the engine rotation speed Ne and the throttle opening θ from an oxygen sensor basic temperature map (FIG. 10A) having the engine rotation speed Ne and the throttle opening θ as axes.

The oxygen sensor basic temperature map shown in FIG. 10A is obtained by attaching a temperature sensor capable of measuring the sensor element temperature directly to the oxygen sensor 11 during calibration of the vehicle prior to shipment, and measuring the sensor element temperature of the oxygen sensor 11 accurately at each engine load by experiment.

Note that a temperature sensor is attached to the oxygen sensor 11 only during calibration of the vehicle, and in the case of a mass-produced vehicle, a temperature sensor is not typically attached during estimation/calculation of the sensor element temperature Toe (step S103*b*).

Further, in the case of a vehicle to which an O2 heater (not shown) is attached in order to activate the oxygen sensor 11, a correction is performed in accordance with the effect of heat generated by the O2 heater on the sensor element temperature Toe and disturbance variation such as exhaust gas temperature variation caused by variation in the ignition timing of the engine 19 and the air-fuel ratio.

For example, as specific content of the correction, a voltage applied to the O2 heater is controlled by PWM control following the elapse of a fixed time after the oxygen sensor 11 is activated so as to prevent the amount of heat generated by the O2 heater from varying due to variation in a power supply voltage of an in-vehicle battery (not shown). In so doing, the amount of heat generated by the O2 heater can be kept constant regardless of variation in the power supply voltage, and as a result, the amount of heat generated by the O2 heater can be reproduced when creating the oxygen sensor basic temperature map of FIG. 10A.

Further, to deal with an increase in the exhaust gas temperature occurring when the ignition timing varies from an advanced side to a retarded side, a correction map (not shown) having the ignition timing as an axis may be prepared so that the estimated/calculated sensor element temperature Toe can be corrected when the ignition timing varies to the retarded side of the ignition timing during creation of the oxygen sensor basic temperature map of FIG. 10.

Similarly, in view of the fact that the exhaust gas temperature decreases when the air-fuel ratio is on the rich side and increases when the air-fuel ratio is on the lean side, a correction map (not shown) having the air-fuel ratio as an axis may be prepared so that the estimated/calculated sensor element temperature Toe can be corrected in accordance with variation in the air-fuel ratio.

Furthermore, the exhaust gas temperature increases when the intake air temperature Ta of the engine 19 increases, for example, and therefore the estimated value of the sensor element temperature Toe is corrected by comparing the intake air temperature Ta with the intake air temperature Ta during creation of the oxygen sensor basic temperature map of FIG. 10.

By implementing the correction processing described above on the estimated basic sensor temperature Toeb, the final sensor element temperature (the estimated value thereof) Toe is calculated.

Further, when the estimated value of the sensor element temperature Toe varies greatly in response to variation in the operating conditions, the fuel injection amount from the fuel injection module 8 is also affected, and therefore rapid variation in the sensor element temperature Toe is undesirable. Hence, filter calculation processing is implemented on the calculated sensor element temperature Toe, as shown below in Equation (3), in order to calculate a filter calculation-processed sensor element temperature Toef.

$$Toef(n)=Toe+Cf\times(Toe-Toef(n-1))/R \quad (3)$$

In Equation (3), Toef (n) denotes the newest filter calculation-processed oxygen sensor element temperature, and Toef (n−1) denotes the previous value thereof. Further, Cf is a filter factor having a resolution R.

Hence, in step S103*b*, the sensor element temperature Toef subjected to filter processing (smoothing calculation) using Equation (3) is set as the final sensor element temperature Toe.

In step S103*c*, the air-fuel ratio determination voltage updating unit 21*c* corrects and updates the determination voltages set in relation to the oxygen sensor output VO2 in order to determine the air-fuel ratio regions of the engine in the following step S103. Here, it is assumed that the air-fuel ratio of the engine 19 is classified into four regions, and therefore the determination voltages to be corrected and updated are the first determination voltage that differentiates the first rich region R1 from the second rich region R2 and the second determination voltage that differentiates the first lean region R4 from the second lean region R3. When the air-fuel ratio of the engine 19 is classified into more than four regions, the number of determination voltages may be increased and then corrected and updated using a similar method. The target voltage indicating the stoichiometric air-fuel ratio (=14.7) is used to differentiate the rich side from the lean side.

The determination voltages set in the control unit 1 are brought closer to the actual oxygen sensor output characteristic by implementing following processing.

First, when the amount of variation in the sensor element temperature of the oxygen sensor 11 remains at or above a threshold continuously for at least a set time, a determination voltage update condition is determined to be established.

When the determination voltage update condition is established, the first determination voltage and second determination voltage used to detect the air-fuel ratio of the engine 19 are updated on the basis of the oxygen sensor element temperature using Equation (4), shown below.

$$\text{first determination voltage}(n)=\text{first determination voltage}(n-1)\times\text{Cof} \quad (4)$$

A correction coefficient Cof is determined in accordance with the oxygen sensor element temperature so as to be smaller when the sensor element temperature is higher than a reference sensor element temperature Tst and larger when the sensor element temperature is lower than the reference sensor element temperature Tst.

Further, the sensor element temperature and the characteristic of the oxygen sensor may be measured by experiment, and on the basis of the results, determination voltages may be prepared in advance for each sensor element temperature.

A similar correction to that of Equation (4) is implemented likewise on the second determination voltage, although in the case of the second determination voltage, Cof is increased when the sensor element temperature is higher than the reference sensor element temperature Tst and reduced when the sensor element temperature is lower than the reference sensor element temperature Tst.

In step S104*a*, proportional gains Gp1, Gp2 are determined, and in step S105*a*, integral gains Gi1, Gi2 are determined.

A method employed in step S104*a* to determine the proportional gains is as follows.

First, the proportional gain Gp1 based on the air-fuel ratio region of the engine 19 is calculated from a map of the air-fuel ratio region of the engine 19 and the proportional gain Gp1, such as that shown in FIG. 5A. In other words, when the air-fuel ratio of the engine 19 belongs to the first rich region R1, a value of −0.01 is derived as Gp1.

Next, the proportional gain Gp2 is determined. The proportional gain Gp2 is a proportional gain based on a determination result indicating whether the oxygen sensor output value VO2 is a higher voltage or a lower voltage than (i.e. on the rich side or the lean side of) the stoichiometric air-fuel ratio (the target voltage) VO2*t*. The proportional gain Gp2 is determined according to whether the air-fuel ratio of the engine 19 is rich or lean. Hence, although the proportional gain Gp2 takes various values depending on operating conditions such as the engine rotation speed and the throttle opening, the value thereof is not affected by the magnitude of the air-fuel ratio of the engine 19.

The proportional gain Gp2 is calculated from a second proportional gain map such as that shown in FIG. 5B on the basis of the determination result indicating whether the air-fuel ratio of the engine 19 is rich or lean. A value of the proportional gain Gp2 when the air-fuel ratio is lean and a value of the proportional gain Gp2 when the air-fuel ratio is rich are stored respectively on the second proportional gain map shown in FIG. 5B. In other words, when the oxygen sensor output value VO2 is a high voltage (on the rich side), a value of −0.005 is derived as Gp2.

A method employed in step S105*a* to determine the integral gains is as follows.

First, the integral gain Gi1 based on the air-fuel ratio region of the engine 19 is calculated from a map of the air-fuel ratio region of the engine 19 and the integral gain Gi1, such as that shown in FIG. 6A. In other words, when the air-fuel ratio of the engine 19 belongs to the first rich region R1, a value of −0.001 is derived as Gi1.

Next, the integral gain Gi2 is determined. The integral gain Gi2 is an integral gain based on a determination result indicating whether the oxygen sensor output value VO2 is a higher voltage or a lower voltage than (i.e. on the rich side or the lean side of) the stoichiometric air-fuel ratio (the target voltage) VO2*t*. The integral gain Gi2 is determined according to whether the air-fuel ratio of the engine 19 is rich or lean. Hence, although the integral gain Gi2 takes various values depending on operating conditions such as the engine rotation speed and the throttle opening, the value thereof is not affected by the magnitude of the air-fuel ratio of the engine 19.

The integral gain Gi2 is calculated from a second integral gain map such as that shown in FIG. 6B on the basis of the determination result indicating whether the air-fuel ratio of the engine 19 is rich or lean. A value of the integral gain Gi2 when the air-fuel ratio is lean and a value of the integral gain Gi2 when the air-fuel ratio is rich are stored respectively on the second integral gain map shown in FIG. 6B. In other words, when the oxygen sensor output value VO2 is a high voltage (on the rich side), a value of −0.0005 is derived as Gi2.

In step S106*a*, the result obtained by the engine operating condition detection unit in step S103*a* is referenced. When the engine 19 is in the transient operating condition, the processing advances to step S106*b*, and when the engine 19 is not in the transient operating condition, the processing advances to step S106*c*.

The final proportional gain Gp and the final integral gain Gi are then calculated in either step S106*b* or step S106*c*. More specifically, when the engine 19 is in the transient operating condition, the final proportional gain Gp and the final integral gain Gi are calculated respectively as Gp=Gp1 (the proportional gain based on the air-fuel ratio region of the engine) and Gi=Gi1 (the integral gain based on the air-fuel ratio region of the engine) in step S106*b*, whereupon the processing advances to step S106. When the engine 19 is not in the transient operating condition, the final proportional gain Gp and the final integral gain Gi are calculated respectively as Gp=Gp2 and Gi=Gi2 in step S106*c*, whereupon the processing advances to step S106.

Hereafter, the air-fuel ratio feedback control correction amount Kfb calculated from the proportional gain Gp2 and the integral gain Gi2 will be referred to as a second feedback control correction amount.

Note that the second feedback control correction amount is determined by inserting Gi2 and Gp2 respectively as Gi and Gp in Equations (1) and (2), shown above.

Hence, according to this modified example of the first embodiment of this invention, by estimating the sensor element temperature of the oxygen sensor 11, the air-fuel ratio region of the engine 19 can be selected in accordance with the sensor element temperature, enabling an improvement in the convergence performance when the air-fuel ratio of the engine 19 is much richer or much leaner than the target voltage, for example when the air-fuel ratio belongs to the first rich region R1 or the first lean region R4. Further, by implementing the air-fuel ratio feedback control based on the air-fuel ratio region of the engine 19 only when the engine 19 is in the transient operating condition, adverse effects generated when an error occurs during estimation of the sensor element temperature of the oxygen sensor 11 can be suppressed.

In the first embodiment, as described above, the engine control apparatus includes the oxygen sensor 11 that outputs the oxygen sensor output value corresponding to the operating condition information of the engine 19 and the oxygen concentration of the exhaust gas, and the air-fuel ratio feedback control unit 20 that performs air-fuel ratio feedback control on the basis of the oxygen sensor output value VO2 in order to adjust the amount of fuel injected into the engine 19.

The air-fuel ratio feedback control unit 20 includes the air-fuel ratio region detection unit 21 that detects the air-fuel ratio region, among the four or more preset air-fuel ratio regions, to which the air-fuel ratio of the engine 19 belongs on the basis of the oxygen sensor output value VO2, and the air-fuel ratio feedback control correction amount calculation units 22*a*, 23*a*, 24 that calculate the first feedback control correction amount Kfb for use during the air-fuel ratio feedback control in accordance with the air-fuel ratio region detected by the air-fuel ratio region detection unit 21.

Note that the four or more regions include at least the first rich region R1 and the second rich region R2, which are set on the rich side of the stoichiometric air-fuel ratio in ascending order of the air-fuel ratio value, and the first lean region R4 and the second lean region R3, which are set on the lean side of the stoichiometric air-fuel ratio in descending order of the air-fuel ratio value. The air-fuel ratio region detection unit 21 includes the first determination voltage, which is set at a higher value than a target voltage value that is a voltage value indicating the stoichiometric air-fuel ratio, and the second determination voltage, which is set at a lower value than the target voltage value. The air-fuel ratio region detection unit 21 compares the oxygen sensor output value VO2 respectively with the first determination voltage and the second determination voltage. As a result of the determination, the air-fuel ratio region detection unit 21 determines that the air-fuel ratio of the engine 19 is within the first rich region R1 when the oxygen sensor output value VO2 equals or exceeds the first determination voltage, determines that the air-fuel ratio of the engine 19 is within the second rich region R2 when the oxygen sensor output value VO2 equals or exceeds the target voltage value but is lower than the first determination voltage, determines that the air-fuel ratio of the engine 19 is within the second lean region R3 when the oxygen sensor output value VO2 equals or exceeds the second determination voltage but is lower than the target voltage value, and determines that the air-fuel ratio of the engine 19 is within the first lean region R4 when the oxygen sensor output value VO2 is lower than the second determination voltage.

Hence, in the first embodiment, the air-fuel ratio of the engine 19 is classified into four or more regions on the basis of the oxygen sensor output value VO2 of the oxygen sensor 11, whereupon air-fuel ratio feedback control is implemented on the basis of the classification result. Therefore, when an error occurs during estimation of the sensor element temperature, the effect of the error can be reduced. Moreover, according to the first embodiment, convergence of the air-fuel ratio can be achieved more quickly than with binary air-fuel ratio feedback control based on the richness or leanness of the air-fuel ratio, which is in wide general use. Furthermore, there is no need to employ a large memory or a high-performance CPU, and no need to provide a sensor to measure the sensor element temperature of the oxygen sensor 11 directly. As a result, costs can be suppressed.

Moreover, according to the modified example of the first embodiment, the air-fuel ratio feedback control unit 20 further includes the oxygen sensor element temperature estimation unit 21*b* that estimates the temperature of the sensor element constituting the oxygen sensor 11, and the air-fuel ratio determination voltage updating unit 21*c* that corrects at least one of the first determination voltage and the second determination voltage on the basis of the sensor element temperature estimated by the oxygen sensor element temperature estimation unit 21*b*.

When the estimated temperature of the sensor element is higher than a reference value, the air-fuel ratio determination voltage updating unit 21*c* updates at least one of the first determination voltage and the second determination voltage such that the first determination voltage is reduced below the current value and the second determination voltage is increased above the current value, and when the estimated temperature of the sensor element is lower than the reference value, the air-fuel ratio determination voltage updating unit 21*c* updates at least one of the first determination voltage and the second determination voltage such that the first determination voltage is increased above the current value and the second determination voltage is reduced below the current value. Hence, the first determination voltage and the second determination voltage are corrected and updated on the basis of the sensor element temperature, and therefore, when the air-fuel ratio of the engine 19 is classified into four or more regions on the basis of the oxygen sensor output value VO2 of the oxygen sensor 11, the air-fuel ratio can be classified more accurately. As a result, convergence of the air-fuel ratio can be achieved even more quickly.

The air-fuel ratio feedback control unit 20 further includes the engine transient operating condition detection unit 21*a* that determines whether or not the engine 19 is in the transient operating condition on the basis of the operating conditions of the engine detected by the sensor group 15.

The air-fuel ratio feedback control correction amount calculation units 22*a*, 23*a*, 24 determine whether or not the oxygen sensor output value equals or exceeds the target voltage value, calculate the second feedback control correction amount for use during air-fuel ratio feedback control corresponding to the determination result, output the first feedback control correction amount as the final feedback control correction amount when the transient operating condition detection unit 21*a* determines that the engine is in the transient operating condition, and output the second feedback control correction amount as the final feedback control correction amount when the transient operating condition detection unit 21*a* determines that the engine is not in the transient operating condition.

By implementing air-fuel ratio feedback control based on the air-fuel ratio region of the engine 19 only when the engine 19 is in the transient operating condition in this manner, adverse effects generated when an error occurs during estimation of the sensor element temperature of the oxygen sensor 11 can be suppressed.

Second Embodiment

Although not mentioned specifically in the first embodiment, the output value of the oxygen sensor 11 may vary due to manufacturing irregularities in and deterioration of the oxygen sensor 11. In this case, the determination voltages set in advance in order to classify the air-fuel ratio of the engine 19 may not align with the characteristic of the oxygen sensor 11 during actual use. Hence, the determination voltages are preferably updated in response to manufacturing irregularities in and deterioration of the oxygen sensor 11.

An overall configuration of an engine control apparatus according to the second embodiment of this invention is as shown in FIG. 1. The control unit 1 employs a configuration shown in FIG. 11 in place of the configuration shown in FIG. 8.

Figure 11:
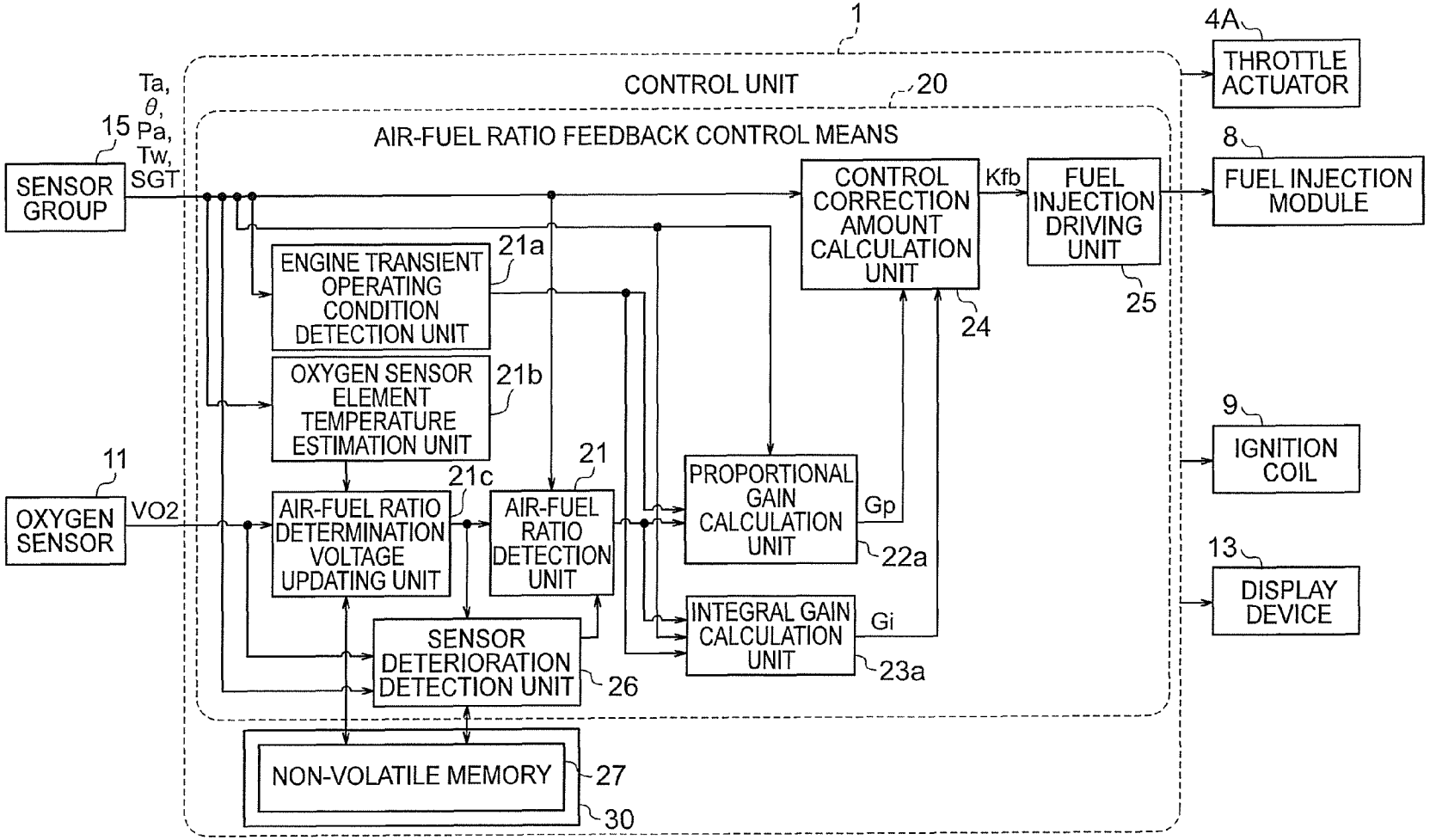
FIG. 11 is a block diagram showing a functional configuration of an engine control apparatus according to a second embodiment of this invention.

FIG. 8 and FIG. 11 differ from each other in that in FIG. 11, a sensor deterioration detection unit 26 and the non-volatile memory 27 are added to the configuration shown in FIG. 8. Further, FIG. 11 differs from FIG. 8 in that the air-fuel ratio determination voltage updating unit 21*c* updates the determination voltages in consideration of manufacturing irregularities in and deterioration of the oxygen sensor 11.

The sensor deterioration detection unit 26 detects sensor deterioration of the oxygen sensor 11. A detection method will be described below.

The non-volatile memory 27 stores the deterioration detection result obtained by the sensor deterioration detection unit 26 even after a power supply of the control unit 1 has been switched OFF. The non-volatile memory 27 is provided in the memory 30 of the control unit 1.

All other configurations are identical to FIG. 8, and will not therefore be described here.

Figure 12:
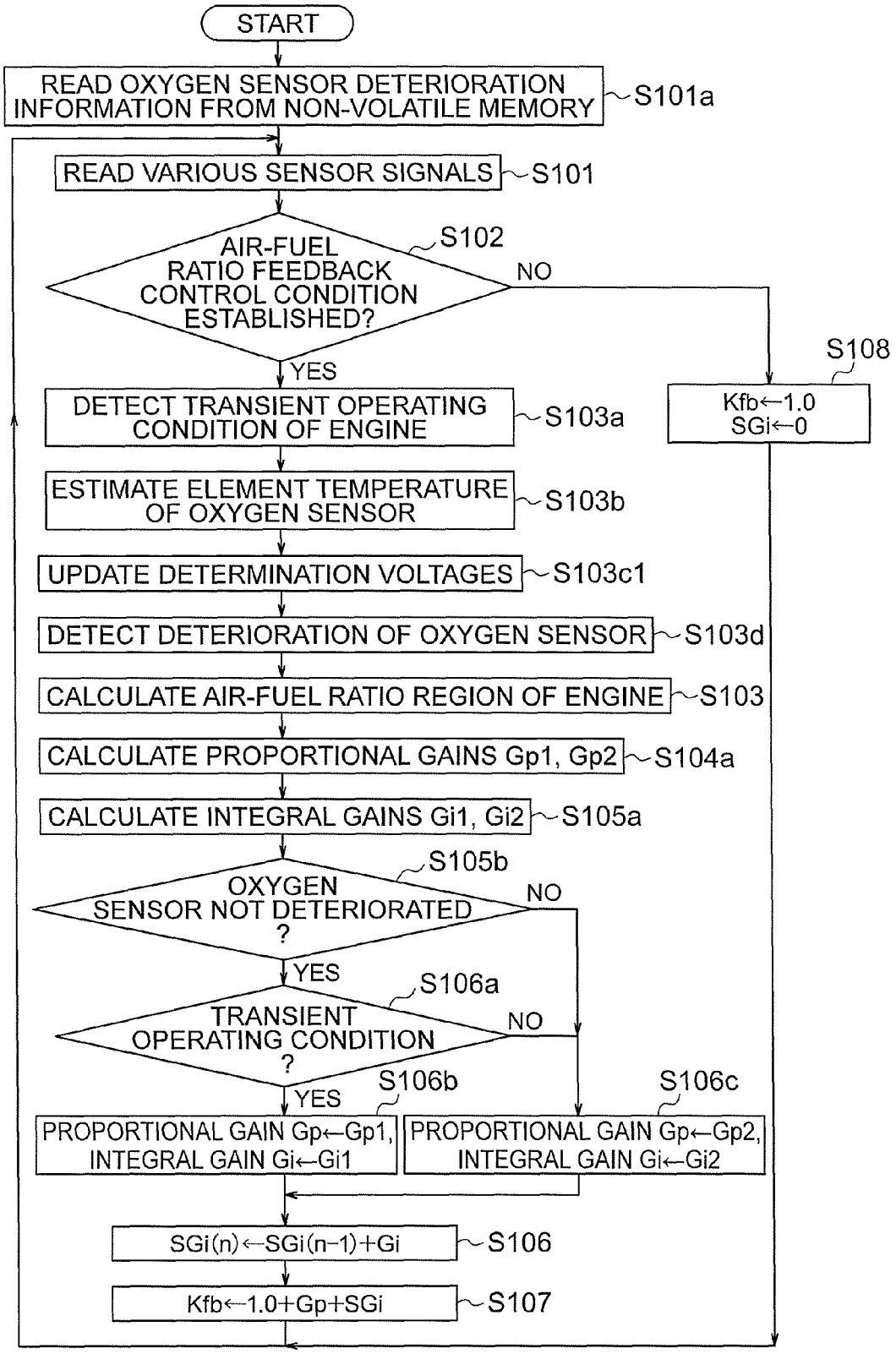
FIG. 12 is a flowchart showing an operation of an air-fuel ratio feedback control unit according to the second embodiment of this invention.

FIG. 12 is a flowchart showing calculation processing performed by the air-fuel ratio feedback control unit 20 according to the second embodiment of this invention. In FIG. 12, processing (see S101*a*, S103*c*1, S103*d*, S105*b*) for dealing with manufacturing irregularities in and deterioration of the oxygen sensor has been added to the flowchart of FIG. 9. Only the additional steps will be described here. When step numbers in the flowchart of FIG. 12 are identical to the step numbers in FIG. 9, identical operations are performed in those steps.

In step S101*a*, the air-fuel ratio feedback control unit 20 reads deterioration information relating to the oxygen sensor 11, which is written to the non-volatile memory 27, in order to obtain information indicating that the oxygen sensor 11 has already been determined to have deteriorated.

In step S103*c*1, the air-fuel ratio feedback control unit 20 uses the air-fuel ratio determination voltage updating unit 21*c* to correct and update the determination voltages set in relation to the oxygen sensor output value VO2. In the first embodiment, the determination voltages are corrected and updated in response to variation in the sensor element temperature. In the second embodiment, a case in which the determination voltages are corrected and updated when the oxygen sensor output value VO2 varies due to manufacturing irregularities in and deterioration of the oxygen sensor 11 will be described.

Step S103*c*1 focuses on a maximum value and a minimum value of the oxygen sensor output value VO2 in a case where the engine 19 is not determined to be in the transient operating condition in step S103*a*, i.e. during a steady state operation. When the oxygen sensor 11 includes manufacturing irregularities or deteriorates, the maximum value and the minimum value vary. Therefore, when the maximum value and the minimum value vary, the air-fuel ratio determination voltage updating unit 21*c* updates and corrects the determination voltages on the assumption that the oxygen sensor 11 includes manufacturing irregularities or has deteriorated. When air-fuel ratio feedback is implemented during a steady state operation, the actual value of the air-fuel ratio of the engine 19 remains stable within a fixed range centering on the stoichiometric air-fuel ratio. The oxygen sensor output value VO2 also varies within a fixed range. More specifically, as indicated by a graph of a "normal oxygen sensor" in FIG. 13, the oxygen sensor output value VO2 varies within a range of 0 to 1 V, centering on approximately 0.45 V.

However, when the output characteristic of the oxygen sensor 11 varies due to manufacturing irregularities in or deterioration of the oxygen sensor 11, the oxygen sensor output value VO2 varies relative to the air-fuel ratio. Therefore, by detecting the variation in the oxygen sensor output value VO2, a determination can be made as to whether or not the output characteristic of the oxygen sensor 11 has varied. For this purpose, first, an average value of the maximum value of the oxygen sensor output value VO2 during a steady state operation is determined over a preset fixed period. When the average value differs from an average value (a reference value) of the maximum value stored in the control unit 1, it can be determined that the output characteristic of the oxygen sensor 11 has varied. In this case, the determination voltages used to define the air-fuel ratio regions of the engine 19 are corrected and updated. Note that an average value of the minimum value of the oxygen sensor output value VO2 may be determined in addition to the average value of the maximum value.

When the engine 19 is not warm, the air-fuel ratio of the engine 19 may be unstable and the sensor element temperature of the oxygen sensor 11 may not have risen sufficiently. As a result, the true sensor output characteristic may not be exhibited. Therefore, step S103*c*1 is implemented when the engine 19 is sufficiently warm. It is also preferable not to implement step S103*c*1 when the environmental temperature is extremely low or extremely high. Hence, a condition according to which step S103*c*1 is implemented only when a sufficient amount of time has elapsed following implementation of the air-fuel ratio feedback control may be added.

When the average value of the maximum value of the oxygen sensor output value VO2 during a steady state operation is lower or higher than the average value (the reference value) stored in the control unit 1, the first determination voltage is corrected and updated in accordance with Equation (5), shown below.

$$\text{first determination voltage}(n)=\text{first determination voltage}(n-1)\times \text{Cof}a \quad (5)$$

In Equation (5), Cofa is a preset correction coefficient. At least two correction coefficients Cofa are prepared, one of which takes a value smaller than 1 and the other of which takes a value larger than 1. When the average value of the maximum value of the oxygen sensor output value VO2 during a steady state operation is lower than the average value (the reference value) of the maximum value stored in the control unit 1, the value smaller than 1 is used as the correction coefficient Cofa. As a result, the first determination voltage (n) is reduced below the current value. When the average value of the maximum value of the oxygen sensor output value VO2 during a steady state operation is higher than the average value of the maximum value stored in the control unit 1, on the other hand, the value larger than 1 is used as the correction coefficient Cofa. As a result, the first determination voltage (n) is increased above the current value.

Further, when the average value of the minimum value is determined together with the average value of the maximum value, the average value of the minimum value may be compared with an average value (a reference value) of the minimum value stored in the control unit 1, similarly to the average value of the maximum value. The first determination voltage and the second determination voltage may then be updated only when the average value of the maximum value differs from the reference value and the average value of the minimum value differs from the reference value. In this case, the determination values are updated less frequently, but variation in the characteristic of the oxygen sensor 11 can be determined more carefully, and therefore updating errors can be suppressed.

Furthermore, the second determination voltage is corrected in addition to the first determination voltage using a similar equation to Equation (5). The correction coefficient Cofa used at this time may be set for each of the first determination voltage and the second determination voltage, or identical values may be used for ease.

The first determination voltage, the second determination voltage, and the average values of the maximum value and minimum value of the oxygen sensor output value VO2, obtained in this step, are stored in the non-volatile memory 27.

Figure 13:
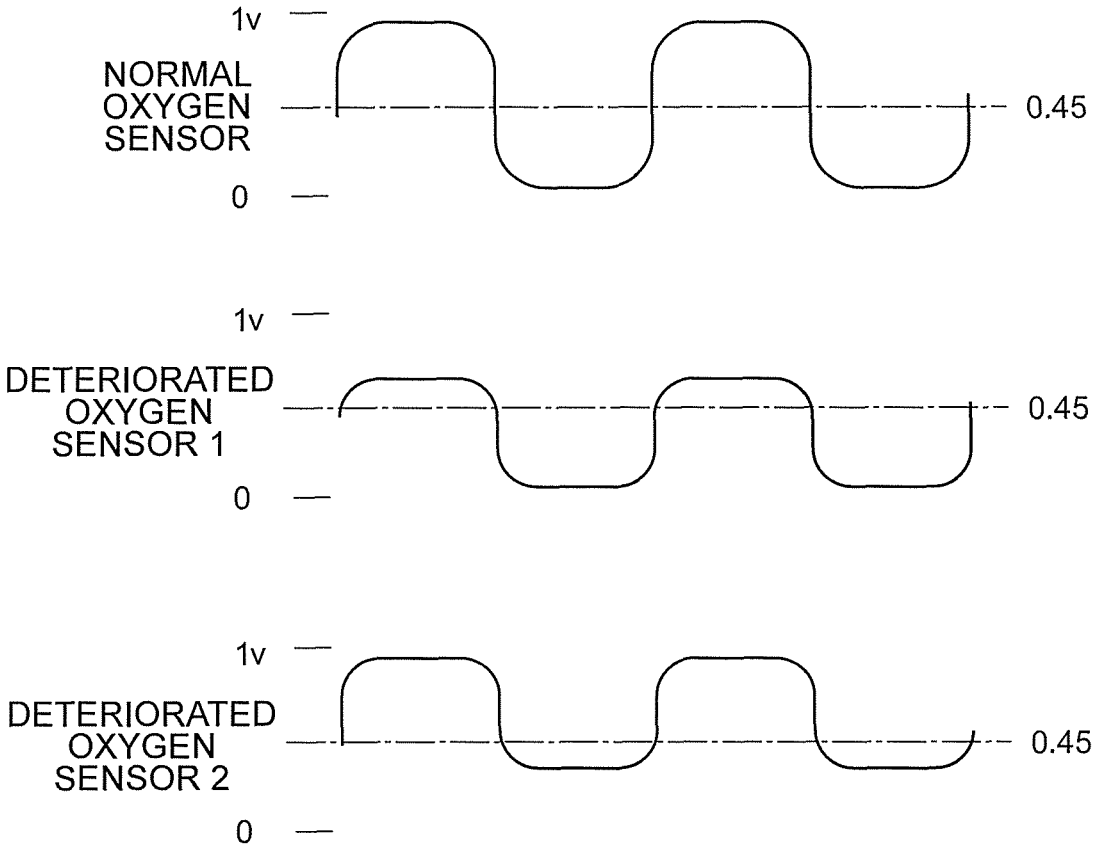
FIG. 13 is an illustrative view showing a deterioration condition of an oxygen sensor according to the second embodiment of this invention.

In step S103*d*, the air-fuel ratio feedback control unit 20 uses the sensor deterioration detection unit 26 to detect the presence of deterioration in the oxygen sensor 11. As described above, it is known that the output value of a "normal oxygen sensor" is typically between 0 and 1 V, and centers on approximately 0.45 V, as shown in FIG. 13. However, it is also known that when the oxygen sensor 11 deteriorates, the high voltage side voltage value and the low voltage side voltage value shift. In other words, the high voltage side decreases from 1 V to 0.9 V to 0.8 V and so on to 0.5 V (1 V→0.9 V→0.8 V→ . . . →0.5 V), as indicated by a "deteriorated oxygen sensor 1" in FIG. 13, and the low voltage side increases from 0 V to 0.1 V to 0.2 V and so on to 0.4 V (0 V→0.1V→0.2 V→ . . . →0.4V), as indicated by a "deteriorated oxygen sensor 2" in FIG. 13.

In step S103*d*, a threshold determination is performed using the average values of the maximum value and the minimum value of the oxygen sensor output value VO2, determined in step S103*a*. In other words, the average value of the maximum value and the average value of the minimum value are compared respectively with preset deterioration determination values 1 and 2. When, as a result of the comparison, the average value of the maximum value of the oxygen sensor 11>the deterioration determination value 1 or the average value of the minimum value of the oxygen sensor 11<the deterioration determination value 2, the oxygen sensor 11 is determined to have deteriorated.

Note that the deterioration determination value 1 and the deterioration determination value 2 are determined by experiment on the basis of an amount of harmful exhaust gas discharged when air-fuel ratio feedback travel is performed after shifting the oxygen sensor output value VO2 respectively to a high voltage side voltage and a low voltage side voltage. In other words, a high voltage side deviation value and a low voltage side deviation value obtained when the amount of discharged exhaust gas exceeds a threshold are determined and set respectively as the deterioration determination value 1 and the deterioration determination value 2.

The deterioration determination values differ according to the type of the engine, but in experiments, the deterioration determination value 1 and the deterioration determination value 2 are often found to be approximately 0.6 to 0.8 V and approximately 0.3 to 0.4 V, respectively.

Further, on the illustrative view showing the deterioration condition in FIG. 13, the voltage value undergoes a simple shift in response to deterioration of the oxygen sensor 11, but when a response speed varies due to deterioration, the voltage value may undergo a gradual shift.

When the oxygen sensor 11 is determined to have deteriorated in step S103*d*, deterioration information relating to the oxygen sensor 11 is written to the non-volatile memory 27.

In step S105*b*, the deterioration detection result obtained in relation to the oxygen sensor 11 in step S103*d* is referenced. When deterioration has not been determined, the processing advances to step S106*a*, and when deterioration has been determined, the processing advances to step S106*c*.

Hence, according to the second embodiment, when the oxygen sensor output value VO2 varies due to manufacturing irregularities in or deterioration of the oxygen sensor 11, the determination voltages can be updated. In so doing, the air-fuel ratio regions of the engine 19 can be divided in accordance with the oxygen sensor output value VO2. Thus, optimum proportional and integral gains for the air-fuel ratio feedback control can be selected, and as a result, convergence on the target voltage can be achieved more quickly. Further, when determining deterioration of the oxygen sensor 11, air-fuel ratio feedback is implemented on the basis of a conventional method that is in general use (i.e. whether the air-fuel ratio is rich or lean), and therefore an effect on control of the air-fuel ratio of the engine 19 can be minimized.

According to the second embodiment, as described above, similar effects to the first embodiment are obtained. In addition, according to the second embodiment, the air-fuel ratio feedback control unit 20 includes the transient operating condition detection unit 21*a* that determines whether the engine 19 is in the transient operating condition or the steady state operating condition on the basis of the engine operating conditions detected by the sensor group 15 that detects engine operating conditions including at least one of the engine rotation speed, the throttle opening, and the engine temperature. Furthermore, the air-fuel ratio feedback control unit 20 includes the air-fuel ratio determination voltage updating unit 21*c* that determines the average value of the maximum value or the average value of the minimum value of the oxygen sensor output value VO2 over a preset period in a state in which the engine 19 is determined to be in the steady state operating condition by the transient operating condition detection unit 21*a*, and corrects at least one of the first determination voltage and the second determination voltage when the average value of the maximum value or the average value of the minimum value differs from the reference value set in relation thereto. When the average value of the maximum value or the average value of the minimum value is lower than the reference value set in relation thereto, the air-fuel ratio determination voltage updating unit 21*c* reduces at least one of the first determination voltage and the second determination voltage below the current value, and when the average value of the maximum value or the average value of the minimum value is higher than the reference value set in relation thereto, the air-fuel ratio determination voltage updating unit 21*c* increases at least one of the first determination voltage and the second determination voltage above the current value.

The average value of the maximum value and the average value of the minimum value vary when the oxygen sensor 11 deteriorates, and therefore, by comparing the average values with the corresponding reference values, it is possible to determine whether or not the oxygen sensor 11 has deteriorated. Moreover, when the oxygen sensor 11 is determined to have deteriorated, the determination voltages are corrected and updated in accordance with the deterioration, and as a result, the air-fuel ratio of the engine 19 can be classified more accurately.

Furthermore, in this embodiment, the air-fuel ratio feedback control correction amount calculation units 22*a*, 23*a*, 24 output the second feedback control correction amount as the final feedback control correction amount when the sensor deterioration detection unit 26 detects deterioration of the oxygen sensor 11, output the first feedback control correction amount as the final feedback control correction amount when the sensor deterioration detection unit 26 does not detect deterioration of the oxygen sensor 11 and the engine transient operating condition detection unit 21*a* determines that the engine 19 is in the transient operating condition, and output the second feedback control correction amount as the final feedback control correction amount when the sensor deterioration detection unit 26 does not detect deterioration of the oxygen sensor 11 and the engine transient operating condition detection unit 21*a* determines that the engine 19 is not in the transient operating condition.

Hence, when deterioration of the oxygen sensor 11 is determined, air-fuel ratio feedback is implemented on the basis of a conventional method that is in general use (i.e. whether the air-fuel ratio is rich or lean), and therefore an effect on control of the air-fuel ratio of the engine 19 can be minimized. Further, similarly to the modified example of the first embodiment, the air-fuel ratio feedback control based on the air-fuel ratio region of the engine 19 is implemented only when the engine 19 is in the transient operating condition, and therefore adverse effects generated when an error occurs during estimation of the sensor element temperature of the oxygen sensor 11 can be suppressed.

Note that in the second embodiment, the determination voltages may be corrected and updated in step S103*c*1 in response to variation in the sensor element temperature, similarly to the first embodiment.

What is claimed is:

1. An engine control apparatus, comprising:

an oxygen sensor that outputs an oxygen sensor output value corresponding to an oxygen concentration of exhaust gas exhausted from an engine; and an air-fuel ratio feedback control unit that performs air-fuel ratio feedback control on the basis of the oxygen sensor output value in order to adjust an amount of fuel injected into the engine, the air-fuel ratio feedback control unit including:

an air-fuel ratio region detection unit that detects an air-fuel ratio region, among four or more preset air-fuel ratio regions, to which an air-fuel ratio of the engine belongs on the basis of the oxygen sensor output value; and an air-fuel ratio feedback control correction amount calculation unit that calculates a first feedback control correction amount for use during the air-fuel ratio feedback control in accordance with the air-fuel ratio region detected by the air-fuel ratio region detection unit, wherein the four or more regions include at least a first rich region and a second rich region set on a rich side of a stoichiometric air-fuel ratio in ascending order of a value of the air-fuel ratio, and a first lean region and a second lean region set on a lean side of the stoichiometric air-fuel ratio in descending order of the value of the air-fuel ratio, and the air-fuel ratio region detection unit:

includes a first determination voltage set at a higher value than a target voltage value that is a voltage value indicating the stoichiometric air-fuel ratio, and a second determination voltage set at a lower value than the target voltage value;

compares the oxygen sensor output value respectively with the first determination voltage and the second determination voltage;

determines that the air-fuel ratio of the engine is within the first rich region when the oxygen sensor output value equals or exceeds the first determination voltage;

determines that the air-fuel ratio of the engine is within the second rich region when the oxygen sensor output value equals or exceeds the target voltage value but is lower than the first determination voltage;

determines that the air-fuel ratio of the engine is within the second lean region when the oxygen sensor output value equals or exceeds the second determination voltage but is lower than the target voltage value; and determines that the air-fuel ratio of the engine is within the first lean region when the oxygen sensor output value is lower than the second determination voltage, wherein a rate of change of the oxygen sensor output value varies relative to the air-fuel ratio of the engine, and wherein the first determination voltage and the second determination voltage are set such that, at a predetermined temperature of the oxygen sensor;

when the oxygen sensor output value exceeds the first determination voltage, the rate of change of the oxygen sensor output value varies at a first rate relative to the air-fuel ratio of the engine, when the oxygen sensor output value is between the first determination voltage and the second determination voltage, the rate of change of the oxygen sensor output value varies at a second rate relative to the air-fuel ratio of the engine, and when the oxygen sensor output value is lower than the second determination voltage, the rate of change of the oxygen sensor output value varies at a third rate relative to the air-fuel ratio of the engine, wherein the second rate is greater than the first rate and the third rate.

2. The engine control apparatus according to claim 1, wherein the air-fuel ratio feedback control unit further includes:

a sensor element temperature estimation unit that estimates a temperature of a sensor element constituting the oxygen sensor; and an air-fuel ratio determination voltage updating unit that corrects at least one of the first determination voltage and the second determination voltage on the basis of the temperature of the sensor element estimated by the sensor element temperature estimation unit, and the air-fuel ratio determination voltage updating unit:

corrects at least one of the first determination voltage and the second determination voltage such that the first determination voltage is reduced below a current value and the second determination voltage is increased above a current value when the estimated temperature of the sensor element is higher than a reference value; and corrects at least one of the first determination voltage and the second determination voltage such that the first determination voltage is increased above the current value and the second determination voltage is reduced below the current value when the estimated temperature of the sensor element is lower than the reference value.

3. The engine control apparatus according to claim 1, further comprising a sensor group that detects operating conditions of the engine, the operating conditions including at least one of an engine rotation speed, a throttle opening, and an engine temperature, wherein the air-fuel ratio feedback control unit further includes:

a transient operating condition detection unit that determines whether the engine is in a transient operating condition or a steady state operating condition on the basis of the operating conditions of the engine detected by the sensor group; and an air-fuel ratio determination voltage updating unit that determines an average value of a maximum value or an average value of a minimum value of the oxygen sensor output value over a preset period in a state in which the engine is determined to be in the steady state operating condition by the transient operating condition detection unit, and corrects at least one of the first determination voltage and the second determination voltage when the average value of the maximum value or the average value of the minimum value differs from a reference value set in relation thereto, and the air-fuel ratio determination voltage updating unit:

reduces at least one of the first determination voltage and the second determination voltage below a current value when the average value of the maximum value or the average value of the minimum value is lower than the reference value set in relation thereto; and increases at least one of the first determination voltage and the second determination voltage above the current value when the average value of the maximum value or the average value of the minimum value is higher than the reference value set in relation thereto.

4. The engine control apparatus according to claim 1, further comprising a sensor group that detects operating conditions of the engine, wherein the air-fuel ratio feedback control unit further includes a transient operating condition detection unit that determines whether or not the engine is in a transient operating condition on the basis of the operating conditions of the engine detected by the sensor group, and the air-fuel ratio feedback control correction amount calculation unit:

calculates a second feedback control correction amount for use during the air-fuel ratio feedback control on the basis of a determination result indicating whether or not the oxygen sensor output value equals or exceeds the target voltage value;

outputs the first feedback control correction amount as a final feedback control correction amount when the transient operating condition detection unit determines that the engine is in the transient operating condition; and outputs the second feedback control correction amount as the final feedback control correction amount when the transient operating condition detection unit determines that the engine is not in the transient operating condition.

5. The engine control apparatus according to claim 2, further comprising a sensor group that detects operating conditions of the engine, wherein the air-fuel ratio feedback control unit further includes a transient operating condition detection unit that determines whether or not the engine is in a transient operating condition on the basis of the operating conditions of the engine detected by the sensor group, and the air-fuel ratio feedback control correction amount calculation unit:

calculates a second feedback control correction amount for use during the air-fuel ratio feedback control on the basis of a determination result indicating whether or not the oxygen sensor output value equals or exceeds the target voltage value;

outputs the first feedback control correction amount as a final feedback control correction amount when the transient operating condition detection unit determines that the engine is in the transient operating condition; and outputs the second feedback control correction amount as the final feedback control correction amount when the transient operating condition detection unit determines that the engine is not in the transient operating condition.

6. The engine control apparatus according to claim 4, wherein the air-fuel ratio feedback control unit further includes a sensor deterioration detection unit that detects deterioration of the oxygen sensor, and the air-fuel ratio feedback control correction amount calculation unit:

outputs the second feedback control correction amount as the final feedback control correction amount when the sensor deterioration detection unit detects deterioration of the oxygen sensor;

outputs the first feedback control correction amount as the final feedback control correction amount when the sensor deterioration detection unit does not detect deterioration of the oxygen sensor and the transient operating condition detection unit determines that the engine is in the transient operating condition; and outputs the second feedback control correction amount as the final feedback control correction amount when the sensor deterioration detection unit does not detect deterioration of the oxygen sensor and the transient operating condition detection unit determines that the engine is not in the transient operating condition.

7. The engine control apparatus according to claim 5, wherein the air-fuel ratio feedback control unit further includes a sensor deterioration detection unit that detects deterioration of the oxygen sensor, and the air-fuel ratio feedback control correction amount calculation unit:

outputs the second feedback control correction amount as the final feedback control correction amount when the sensor deterioration detection unit detects deterioration of the oxygen sensor;

outputs the first feedback control correction amount as the final feedback control correction amount when the sensor deterioration detection unit does not detect deterioration of the oxygen sensor and the transient operating condition detection unit determines that the engine is in the transient operating condition; and outputs the second feedback control correction amount as the final feedback control correction amount when the sensor deterioration detection unit does not detect deterioration of the oxygen sensor and the transient operating condition detection unit determines that the engine is not in the transient operating condition.

* * * * *